US012534907B2

(12) United States Patent
Shachrur et al.

(10) Patent No.: US 12,534,907 B2
(45) Date of Patent: Jan. 27, 2026

(54) SYSTEMS AND METHODS FOR ASSEMBLING PREFABRICATED WALLS

(71) Applicant: Wall to Wall, LLC, Hayward, CA (US)

(72) Inventors: Shai Shachrur, Givat Ela (IL); Yaniv Cohen, Givat Ela (IL); Brad Cameron, Fountain Hills, AZ (US); Amit Haller, Belmont, CA (US); Ami Amiel Shai Avrahami, Rehovot (IL); Ziv Raz, Even Yehuda (IL)

(73) Assignee: Wall to Wall, LLC, Hayward, CA (US)

( * ) Notice: Subject to any disclaimer, the term of this patent is extended or adjusted under 35 U.S.C. 154(b) by 254 days.

(21) Appl. No.: 18/044,702

(22) PCT Filed: Sep. 5, 2021

(86) PCT No.: PCT/IL2021/051088

§ 371 (c)(1),
(2) Date: Mar. 9, 2023

(87) PCT Pub. No.: WO2022/054051

PCT Pub. Date: Mar. 17, 2022

(65) Prior Publication Data

US 2023/0374776 A1 Nov. 23, 2023

Related U.S. Application Data

(60) Provisional application No. 63/203,168, filed on Jul. 12, 2021, provisional application No. 63/076,573, filed on Sep. 10, 2020.

(51) Int. Cl.
*E04B 2/00* (2006.01)
*E04B 1/14* (2006.01)
(Continued)

(52) U.S. Cl.
CPC ..... *E04B 1/6187* (2013.01); *E04B 1/14* (2013.01); *E04B 1/541* (2023.08); *E04B 1/6116* (2013.01)

(58) Field of Classification Search
CPC ..... E04B 2001/3583; E04C 2/38
See application file for complete search history.

(56) References Cited

U.S. PATENT DOCUMENTS 3,755,982 A 9/1973 Schmidt
4,989,386 A 2/1991 Collis
(Continued)

FOREIGN PATENT DOCUMENTS

DE 102011110920 A1 2/2013
WO 0129338 A2 4/2001
WO 2014032558 A1 3/2014

OTHER PUBLICATIONS

Extended European Search Report dated Sep. 25, 2024, directed to European Application No. 21866213.8; 7 pages.
(Continued)

*Primary Examiner* — Basil S Katcheves
(74) *Attorney, Agent, or Firm* — Morrison & Foerster LLP

(57) ABSTRACT

A system for assembling prefabricated walls, said system comprising: at least one prefabricated wall having an anchor pathway extending therethrough along a height thereof and between a bottom opening and a top opening; a first anchoring element; a second anchoring element configured to be coupled to the first anchoring element, and to be slidingly received and extend along within the anchor pathway; and a coupler configured to couple the second anchoring element to the first anchoring element, said bottom opening being configured for slidably receiving the first anchoring element,
(Continued)

the coupler and at least a first end of the second anchoring element coupled to the first anchoring element.

18 Claims, 24 Drawing Sheets

(51) Int. Cl.
*E04B 1/38* (2006.01)
*E04B 1/61* (2006.01)

(56) References Cited

U.S. PATENT DOCUMENTS 5,168,681 A * 12/1992 Ayrapetyan ..... E04B 5/12 52/847
5,384,993 A * 1/1995 Phillips ..... E04B 1/34347 52/223.6
5,444,955 A 8/1995 Ou
5,531,054 A * 7/1996 Ramirez ..... E04H 9/14 52/95
5,535,561 A * 7/1996 Schuyler ..... E04B 1/0007 52/223.13
6,014,843 A * 1/2000 Crumley ..... E04H 9/0237 52/712
6,161,339 A * 12/2000 Cornett, Sr. ..... E04H 9/14 52/223.13
6,256,960 B1 * 7/2001 Babcock ..... E04B 7/22 52/592.1
6,367,205 B2 * 4/2002 Cornett, Sr. ..... E04B 7/02 52/223.13
6,502,357 B1 1/2003 Stuthman
7,150,132 B2 * 12/2006 Commins ..... E04B 1/26 411/536
7,549,263 B1 * 6/2009 Porter ..... E04B 1/14 52/794.1
7,665,257 B2 * 2/2010 Posey ..... E04B 7/04 52/223.13
7,971,411 B2 * 7/2011 Commins ..... E04B 1/2604 52/293.3
8,397,464 B2 * 3/2013 Lin ..... E04B 1/4157 52/701
9,097,001 B2 * 8/2015 Espinosa ..... E04B 1/2604
9,297,176 B2 * 3/2016 Crumley ..... E04B 2/20
9,303,399 B2 * 4/2016 Espinosa ..... E04G 15/04
9,428,902 B1 * 8/2016 LoFranco ..... E04B 1/2608
2003/0230032 A1 * 12/2003 Shahnazarian ..... E04H 9/14 52/223.13
2007/0101678 A1 * 5/2007 Miniter ..... E04C 2/34 52/782.1
2008/0060296 A1 3/2008 Espinosa

OTHER PUBLICATIONS

International Search Report and Written Opinion mailed Jan. 3, 2022, directed to International Application No. PCT/IL2021/051088; 15 pages.

* cited by examiner

SYSTEMS AND METHODS FOR ASSEMBLING PREFABRICATED WALLS

TECHNOLOGICAL FIELD

The presently disclosed subject matter refers in general to the field of assembling prefabricated construction walls.

BACKGROUND

The concept of prefabrication construction is commonly known to include fabrication of a wall panel, prior to delivery to a construction site, in a factory or a workshop, and transporting the prefabricated panels to the construction site for being assembled to form the walls of a building. The wall panels are assembled and installed by the way of various anchoring systems connection the wall panels together on the top of each other and/or sideways.

The customary procedure for connecting the anchorage between the wall panels includes leaving openings in the wall panel, while manufacturing in the factory, to connect the anchoring system during assembling/installation on-site. As a result, there is a lot of on-site work that also necessitates site-inspections. One conventional solution for reducing the open surfaces on the wall opening for access points for the connections, includes using small anchors, that result in tolerance issues.

GENERAL DESCRIPTION

The presently disclosed subject matter according to the aspects detailed below is related to assembly of prefabricated walls. The prefabricated walls are constructed from horizontal and vertical beams e.g. tracks and studs, forming a frame structure and one or more layers to cover the frame from both sides. The prefabricated walls of the presently disclosed subject matter according to the aspects detailed below, include an integral resistance layer having a solid-surface exterior face. The resistance layer can be made of synthetic/man-made materials, for example, comprising one or more of the following materials: an acrylic polymer, a Methyl methacrylate (MM A), an alumina trihydrate (ATH), a polyester, epoxy, composite materials, and any combination thereof. The resistance layer can be characterized by one or more of the following: non-porous, impermeable, low-maintenance, stain resistant, thermoform-able, moisture resistant, heat resistant, fire resistant, easy to clean, anti-bacterial, hard-wearing, highly resistant, easy connectable to one other solid surface materials, and any combination thereof.

An exterior surface, i.e., the surface configured to face away from the frame, of the resistance layer is covered with a finishing layer having an interior surface facing towards the resistance layer and a factory-finished exterior surface. The factory finished exterior surface constitutes a front face and/or a back face of the prefabricated wall, i.e., the face that is configured to face the interior or exterior of the room or building. This feature of the factory-finished exterior face of the prefabricated wall allows using it 'as is', e.g., without requiring any further treatment and finishing after leaving the factory, such as applying coating, painting, etc.

The factory-finished exterior face can be for example, one of the following: Corian®, Avonite Surfaces®, HI-MACS®, KRION®, etc.

The prefabricated walls of the presently disclosed subject matter can be manufactured and constructed in a factory or a workshop according to specific design requirements (e.g., architectural design) and in a precise manner, for example by a CNC machine, and ready to be transported to the construction site completely closed, i.e., with the resistance layer and the finishing layer already being installed with the wall. The closed prefabricated wall can have the frame structure completely covered so as to leave almost no opening in the wall for assembling purposes, thereby leaving little work to be done on-site and requiring no inspections. The prefabricated wall can include therein internal pre-formed openings for accommodating different infrastructure, such as plumbing, piping and electrical and/or communication wiring, and it can include the infrastructure itself, for example, when leaving the factory.

According to a first aspect of the presently disclosed subject matter, there is provided a system for assembling prefabricated walls, said system comprising: at least one prefabricated wall having an anchor pathway extending therethrough along a height thereof and between a bottom opening and a top opening; a first anchoring element; a second anchoring element configured to be coupled to the first anchoring element, and to be slidingly received and extend along within the anchor pathway; and a coupler configured to couple the second anchoring element to the first anchoring element, said bottom opening being configured for slidably receiving the first anchoring element, the coupler and at least a first end of the second anchoring element coupled to the first anchoring element.

The prefabricated wall can be a closed wall with the resistance layer and the finishing layer already been applied onto the frame structure prior to be delivered on-site. The prefabricated wall can comprise a front face and an opposite back face, both the faces constituted by the exterior surface of the finishing layer and separated by a thickness of the prefabricated wall, a top face and an opposite bottom face, each extending between the front and back face and separated by a height of the prefabricated wall, two side faces opposite each other, each extending between the front and back face as well as the top and bottom face and separated by a width of the prefabricated wall.

The anchor pathway can be a bore-hole or a tunnel extending between the top face and the bottom face of the prefabricated wall, and can have a circular or a polygonal shaped cross-section. The anchor pathway can be surrounded on two sides by the vertical beams of the frame structure and the resistance layers on other two sides.

In some examples, the prefabricated wall can be in the form of a column having thickness and width substantially similar, and can have only one anchor pathway. In some examples, the prefabricated wall can have a width substantially larger than the thickness of the wall and can have two side portions separated along the width of the wall with a central portion therebetween. The two side portions can each include a respective anchor pathway. In some examples, the prefabricated wall can have more than two anchor pathways depending upon the width of the wall.

The first anchoring element can be a tension rod configured to at least partially pass through the anchor pathway. In some examples, when the prefabricated wall has more than one anchor tunnels, there can be more than one first anchoring elements corresponding to each anchor tunnel.

The second anchoring element can be a tension rod configured to be coupled to the first anchoring element via the coupler. The coupler can be a coupling nut having two internal threaded portions each configured to be threaded with a corresponding external threaded tip of the first and the second anchoring element. In some examples, a tip of one of the first and the second anchoring elements can have an internal threading and a corresponding tip of the other of the first and the second anchoring elements can have an external threading, and the two tips can constitute the coupler. The bottom opening of the anchor tunnel has dimensions so as to slidably receive the first anchoring element, the coupler, and at least the first end of the second anchoring element.

The system for assembling prefabricated walls according to the first aspect can further comprise an alignment element including a base portion with a through-opening configured to allow the first anchoring element to pass therethrough, and an aligning portion extending from the base portion configured to align the bottom opening of the anchor pathway with the alignment element. The alignment element can be configured to align the prefabricated walls in the designated positions during assembly of the walls and/or in case of lifting of the wall due to external forces like earthquakes etc.

The aligning portion can be configured to be received into the bottom opening of the anchor pathway. The aligning portion can be configured to be partially received into the bottom opening. The aligning portion can comprise at least two main aligning plates perpendicular to the base portion and extending therefrom, and having edges converging in a direction away from the base portion. The slope of the convergence of the edges can be a gradient slope, i.e., the slope can be a variable slope along the length of the edge. A maximum distance between the edges of the main aligning plates corresponds to a respective dimension of the bottom opening. The converging edges are configured to allow a rim of the bottom opening to slide thereon such that the bottom opening gets aligned with the aligning element thereby aligning the prefabricated wall with the alignment element in a first direction.

The main aligning plates can have respective internal surfaces facing each other and opposite external surfaces, wherein the aligning portion can further comprise at least one auxiliary aligning plate extending perpendicularly from the external surface of each of the main aligning plates. Each of the auxiliary aligning plates can have an edge sloped away from the external surface of the main aligning plate in a direction towards the base portion. The slope of the edge of the auxiliary aligning plate is gradient slope. A maximum distance between the edges of the auxiliary aligning plates of the two main aligning plates corresponds to a respective dimension of the bottom opening. The slope of the edges of the auxiliary aligning plates are configured to allow the rim of the bottom opening to slide thereon such that the bottom opening gets aligned with the aligning element thereby aligning the prefabricated wall with the alignment element in a second direction perpendicular to the first direction.

In some examples, the aligning portion can comprise one main aligning plate and one auxiliary aligning plate perpendicular each other and having edges converging in a direction away from the base portion so as to allow the rim of the bottom opening to slide thereon such that the bottom opening gets aligned with the aligning element thereby aligning the prefabricated wall with the alignment element.

In some examples, the aligning portion can have a dome shaped structure converging in a direction away from the base portion so as to align the bottom opening and the wall with the alignment element. In other examples, the aligning portion can have any suitable shape and structure capable of aligning the bottom opening and/or the prefabricated wall with the alignment element.

The system for assembling prefabricated walls according to the first aspect can further comprise a guiding element configured to be positioned at least partially within the anchor pathway in proximity to the top opening thereof. The guiding element can be configured to guide a second end of the second anchoring element into the top opening to pass therethrough from within the anchor pathway. The top opening can be narrower than at least a majority of the anchor pathway, and the guiding element can have a lower end portion having dimensions corresponding to those of the anchor pathway, an upper end portion configured to be positioned adjacent the top opening having dimensions corresponding to those of the top opening, and an intermediate portion extending therebetween.

In some examples, the guiding element can be integrally formed with the anchor pathway. In other examples, the guiding element can be manufactured separately of the anchor pathway.

The system for assembling prefabricated walls according to the first aspect can further comprise a locking element configured to lock the second anchoring element at the top opening. The locking element can include one or more of a lock nut, a jam nut, a washer, or combinations thereof. The locking element can include any mechanism configured to restrain the movement of the second anchoring element with respect to the top opening.

In an example, the at least one prefabricated wall can be configured to be assembled on top of a bottom prefabricated wall identical to the at least one prefabricated wall, wherein the first anchoring element is constituted by an end of another anchoring element protruding from the bottom prefabricated wall. The bottom prefabricated wall can comprise another anchor pathway and the other anchoring element can protrude from the other anchor pathway of the bottom prefabricated wall. The alignment element can be configured to be positioned at top opening of anchor pathway of the bottom prefabricated wall, and can be configured to align the at least one prefabricated wall onto the bottom prefabricated wall. The alignment element can be configured to align the anchor pathway of the at least one prefabricated wall onto the anchor pathway of the bottom prefabricated wall. The guiding element can be configured to be positioned at least partially within the anchor pathway of the bottom prefabricated wall and can be configured to guide the end of the other anchoring element constituting the first anchoring element. The alignment element and the guiding element can be integrally formed as a single element. The alignment element and the guiding element can be separately manufactured.

In another example, a second end of the second anchoring element can be configured to constitute the first anchoring element for another top prefabricated wall identical to the at least one prefabricated wall, and configured to be coupled to another anchoring element and be received in anchor pathway of said other top prefabricated wall. The alignment element can be configured to be positioned at the top opening of the anchor pathway of the at least one prefabricated wall, and can be configured to align the other top prefabricated wall onto the at least one prefabricated wall. The alignment element can be configured to align the anchor pathway of the other top prefabricated wall onto the anchor pathway of the at least one prefabricated wall. The guiding element can be configured to be positioned at least partially within the anchor pathway of the at least one prefabricated wall and is configured to guide the second end of the second anchoring element.

In yet another example, the first anchoring element can protrude from a base support element. The base support element can be a concrete base or steel beam on which the prefabricated walls are to be assembled. The first anchoring element can be connected to the base support element either by welding, bolting, or any mechanical means to attach the first anchoring element to the steel beam or by embedding it into the concrete base. The alignment element can be configured to be positioned at the base support element, and can be configured to align the at least one prefabricated wall onto the base support element.

In general, the system for assembling prefabricated walls according to the first aspect of the presently disclosed subject matter can be brought to the site with the prefabricated walls completely finished, i.e., with all the resistance layers and finishing layers already installed. The first anchoring element can be connected to the base support element with one end connected to the base support element and the other end configured to be coupled to the second anchoring element. A first end of the second anchoring element can be coupled to the first anchoring element by a coupler, and the prefabricated can be lowered onto the second anchoring element while receiving the first end of the second anchoring element, the coupler, and the first anchoring element into the anchor pathway via the bottom opening.

In some examples, the first end of the second anchoring element can be coupled to the first anchoring element while the second anchoring element being completely separated from the prefabricated wall, and the prefabricated can then be lowered onto the second anchoring element while first receiving its second end into the bottom opening and then the first end, the coupler, and the first anchoring element.

In other examples, the second anchoring element can be inserted into the anchor pathway prior to the second element being coupled to the first anchoring element. The prefabricated wall can be lowered up to just above the first anchoring element and then the first end of the second anchoring element can be coupled to the first anchoring element. The prefabricated wall can then be lowered completely to rest on the base support element.

When the prefabricated wall has been completely lowered, a second end of the second anchoring element protrudes from the top opening of the anchor pathway, and can be locked by a locking element such as a lock nut, jam nut, washer, or the like. The second end of the second anchoring element can serve as a first anchoring element for another top prefabricated wall to be assembled on the top of the prefabricated wall. The other top prefabricated wall can include anchor pathway similar to the prefabricated wall and can be assembled in a same way as described above for the prefabricated wall.

An alignment element can be positioned at the base support element such that the first anchoring element passes through the base portion of the alignment element. The alignment element can position the wall precisely in the designated location by aligning the bottom opening of the anchor pathway in the exact location. A guiding element can be positioned within the anchor pathway in proximity to the top opening so as to guide the second end of the second anchoring element through the top opening while the prefabricated wall is being lowered. Another alignment element can be positioned on top of the prefabricated wall in proximity to the top opening such that the second end of the second anchoring element passes through the base portion thereof. The other alignment element can align the other top prefabricated wall in its exact location above the prefabricated wall while aligning the anchor pathway of the top prefabricated wall with the anchor pathway of the prefabricated wall.

According to a second aspect of the presently disclosed subject matter, there is provided a system for assembling prefabricated walls, said system comprising: at least one prefabricated wall having two side portions, a central portion extending therebetween, a bottom portion extending between the side portions and below the central portion, and a top portion extending between the side portions and above the central portion; a first engaging member configured to be positioned at at least one of the top portion, the bottom portion, and the side portions; a second engaging member configured to be connected to an external object and to engage the first engaging member; and a fastening element configured to fasten the first and the second engaging member together.

The at least one prefabricated wall can be a closed wall with the resistance layer and the finishing layer already been applied onto the frame structure prior to be delivered on-site. In some examples, the at least one prefabricated wall according to the second aspect of the presently disclosed subject matter can be identical to the prefabricated wall described above according to the first aspect of the presently disclosed subject matter.

At least a portion of one of the first and the second engaging members can be configured to be received within the other one of the first and the second engaging members.

One of the first and the second engaging members can comprise one or more protrusions and the other one of the first and the second engaging members can comprise corresponding one or more recesses configured to receive therewithin the one or more protrusions. In an example, the one of the first and the second engaging member can comprise a plurality of protrusions, and said other one of the first and the second engaging member can comprise an elongated recess configured to receive therewithin the plurality of protrusions. The elongated recess can be a groove extending along a height or width of the prefabricated wall. In another example, the one of the first and the second engaging member can comprise an elongated protrusion configured to extend along a height or width of the prefabricated wall, and said other one of the first and the second engaging member can comprise an elongated recess configured to receive therewithin the elongated protrusion.

Each of the one or more recesses can comprise a recess base and two recess sides extending therefrom, the recess sides together with the recess base defining the recess. Each of the one or more protrusions can comprise a protrusion top and two protrusion sides extending between the prefabricated wall and the protrusion top. The protrusion top can be configured to engage the recess base, and the protrusions sides can be configured to engage the recess sides.

In some examples, each of the first and the second engaging members can include protrusions configured to extend parallel to each other in different planes perpendicular to a thickness of the prefabricated wall. The first and the second engaging members can be configured to engage each other so as to have an overlapping area in a plane perpendicular to the thickness of the prefabricated wall.

The fastening element can be an elongated element configured to be at least partially inserted through the first and the second engaging members at least when the first and the second engaging members engage each other. The fastening element can be configured to be inserted through the first and the second engaging members in a direction along thickness of the prefabricated wall. The fastening element can be configured to be inserted through at least one of the recess sides.

The first and the second engaging members can comprise respective one or more holes configured to align with each other and to receive therethrough the fastening element, at least when the first and the second engaging members engage each other. At least one of the first and the second engaging members can comprises one or more fastener guides corresponding to at least some of the one or more holes, and configured to guide the fastening element through the respective holes. At least one of said recess sides can comprise said one or more respective holes. The fastener guides can be positioned between the resistance layer and the engaging members. The fastener guide can have a wide end portion configured to be positioned towards the resistance layer, and a narrow end portion configured to align with the hole of the engaging member, and an intermediate portion extending therebetween so as to guide the fastening element into the hole of the engaging member when the fastening element is inserted from the wide end to the narrow end portion.

In some examples, the finishing layer and/or the resistance layer can have an open strip, left open during manufacturing of the prefabricated wall. The first engaging member can be configured to be positioned so as to align with the open strip to allow access to the respective holes for inserting the fastening elements. The open strip can be covered with the resistance and/or finishing layer after the assembly of the prefabricated walls to close the walls completely.

In some examples, particularly when the prefabricated walls are completely closed at the factory prior to be brought to the site, the prefabricated wall can comprise markings representing the locations where the fastening element is to be inserted through the at least one prefabricated wall. The markings can be located on an external surface of the finishing layer as an indication for inserting the fastening element.

In some examples, the fastening elements can be mechanical connection elements such as screw, nail, bolt, bar, or the like. In some examples, the fastening elements can be smart elements configured to provide internal access of the wall for the purpose of inspection, monitoring, and/or maintenance.

In one example, the first engaging member can be configured to be positioned at one of the two side portions, and the second engaging member can be configured to be connected to a side portion of an adjacent prefabricated wall constituting the external object. The elongated recess can have at least one of an open bottom end and an open top end, and can be configured to slidingly receive therewithin said elongated protrusion. The adjacent prefabricated wall can be identical to the at least one prefabricated wall.

In another example, the first engaging member can be configured to be positioned at the bottom portion, and the second engaging member can be configured to be connected to a base support element constituting the external object. The base support element can be a concrete base or steel beam on which the prefabricated walls are to be assembled. The second engaging member can be connected to the base support element either by welding, bolting, or any other mechanical means to connect the second engaging member to the steal beam or by embedding it into the concrete base.

In yet another example, the first engaging member can be configured to be positioned at the top portion, and the second engaging member can be configured to be connected to a bottom portion of another top prefabricated wall constituting the external object. The other top prefabricated wall can be identical to the at least one prefabricated wall.

In yet another example, the first engaging member can be configured to be positioned at the bottom portion, and the second engaging member can be configured to be connected to a top portion of another bottom prefabricated wall constituting the external object.

The at least one prefabricated wall can further comprise: a front face and an opposite back face, a majority of the front and the back faces constituting the central portion; and two side faces extending between said front face and said back face, said two side faces extending together with said front face and said back face between a bottom face and a top face of the prefabricated wall, each of the side portions including a respective one of the two side faces and respective side parts of the front face and the back face, the bottom portion including the bottom face and bottom parts of the front face and the back face, and the top portion including the top face and top parts of the front face and the back face; wherein the first engaging member is positioned at at least one of the bottom face, the top face, and the side faces.

The external faces of the two finishing layers can constitute the front face and the back face of the prefabricated wall. The two side faces, the top face and the bottom face can be constituted by the frame structure.

The fastening element can be configured to be inserted through the first and the second engaging members in a direction extending between the front face and the back face. The fastening element can be configured to be inserted through the first and the second engaging members in a direction perpendicular to at least one of the front face and the back face.

In one example, the first engaging member can be configured to be positioned at one of the two side faces, and the second engaging member can be configured to be connected to a side face of the adjacent prefabricated wall constituting the external object. In another example, the first engaging member can be configured to be positioned at the bottom face.

In yet another example, the first engaging member can be configured to be positioned at the top face, and the second engaging member can be configured to be connected to a bottom face of said other top prefabricated wall constituting the external object.

In yet another example, the first engaging member can be configured to be positioned at the bottom face, and the second engaging member can be configured to be connected to a top face of said other bottom prefabricated wall constituting the external object.

The prefabricated wall according to the second aspect can be identical to, or can include at least some features of, the prefabricated wall described according to the first aspect of the presently disclosed subject matter. For instance, the prefabricated wall according to the second aspect of the presently disclosed subject matter can have the anchor pathway, and can be configured to be assembled with the anchoring elements, alignment elements and guiding elements, in the manner as described above with respect to the first aspect of the presently disclosed subject matter.

In general, the system for assembling prefabricated walls according to the first aspect of the presently disclosed subject matter can be brought to the site with the prefabricated walls completely finished, i.e., with all the resistance layers and finishing layers already installed. The prefabricated walls can have the respective first and second engaging members already installed on the corresponding faces. The second engaging member can be connected to the base support element. The first engaging member can be connected to the bottom face of the prefabricated wall and another first engaging member can be connected to one of the side faces of the prefabricated wall. The prefabricated wall can be lowered onto the base support element and the first engaging member connected to the bottom face and the second engaging member can engage each other. The fastening elements can be inserted through the first and the second engaging members thereby fastening the prefabricated wall with the bottom support element. Another adjacent prefabricated wall having a second engaging member connected to a side face thereof can be lowered adjacent the prefabricated wall while engaging the first engaging member connected to the side face of the prefabricated wall with the second engaging member connected to the side face of the other prefabricated wall. The fastening elements can be inserted through the first and the second engaging members thereby fastening the prefabricated wall with the other adjacent prefabricated wall. Another second engaging member can be connected to the top face of the prefabricated wall, and another top prefabricated wall having a first engaging member connected to a bottom face thereof can be lowered on to the prefabricated wall while engaging the second engaging member connected to the top face of the prefabricated wall with the first engaging member connected to the bottom face of the top prefabricated wall. The fastening elements can be inserted through the first and the second engaging members thereby fastening the top prefabricated wall with the prefabricated wall.

EMBODIMENTS

A more specific description is provided in the Detailed Description whilst the following are non-limiting examples of different embodiments of the presently disclosed subject matter. It should be appreciated that Embodiments 1 to 26 correspond to the first aspect of the presently disclosed subject matter and Embodiments 27-51 correspond to the second aspect of the presently disclosed subject matter.

1. A system for assembling prefabricated walls, said system comprising:
   - at least one prefabricated wall having an anchor pathway extending therethrough along a height thereof and between a bottom opening and a top opening;
   - a first anchoring element;
   - a second anchoring element configured to be coupled to the first anchoring element, and to be slidingly received and extend along within the anchor pathway; and
   - a coupler configured to couple the second anchoring element to the first anchoring element, said bottom opening being configured for slidably receiving the first anchoring element, the coupler and at least a first end of the second anchoring element coupled to the first anchoring element.

2. The system according to Embodiment 1, further comprising an alignment element including a base portion with a through-opening configured to allow the first anchoring element to pass therethrough, and an aligning portion extending from the base portion configured to align the bottom opening of the anchor pathway with the alignment element.

3. The system according to Embodiment 2, wherein the aligning portion is configured to be received into the bottom opening of the anchor pathway.

4. The system according to Embodiment 2 or 3, wherein the aligning portion comprises at least two main aligning plates perpendicular to the base portion and extending therefrom, and having edges converging in a direction away from the base portion.

5. The system of Embodiment 4, wherein a slope of the convergence is gradient slope.

6. The system according to Embodiment 4 or 5, wherein a maximum distance between the edges of the main aligning plates corresponds to a respective dimension of the bottom opening.

7. The system according to any one of Embodiments 4 to 6, wherein the main aligning plates have respective internal surfaces facing each other and opposite external surfaces, wherein the aligning portion further comprises at least one auxiliary aligning plate extending perpendicularly from the external surface of each of the main aligning plates.

8. The system according to Embodiment 7, wherein each of the auxiliary aligning plates has an edge sloped away from the external surface of the main aligning plate in a direction towards the base portion.

9. The system according to Embodiment 8, wherein said slope of the edge of the auxiliary aligning plate is gradient slope.

10. The system according to Embodiment 8 or 9, wherein a maximum distance between the edges of the auxiliary aligning plates of the two main aligning plates corresponds to a respective dimension of the bottom opening.

11. The system according to any one of the preceding Embodiments, further comprising a guiding element configured to be positioned at least partially within the anchor pathway in proximity to the top opening thereof.

12. The system according to Embodiment 11, wherein the guiding element is configured to guide a second end of the second anchoring element into the top opening to pass therethrough from within the anchor pathway.

13. The system according to Embodiment 11 or 12, wherein the top opening is narrower than at least a majority of the anchor pathway, and the guiding element has a lower end portion having dimensions corresponding to those of the anchor pathway, an upper end portion configured to be positioned adjacent the top opening having dimensions corresponding to those of the top opening, and an intermediate portion extending therebetween.

14. The system according to any one of Embodiment 11 to 13, wherein the guiding element is integrally formed with the anchor pathway.

15. The system according to any one of Embodiments 11 to 13, wherein the guiding element is manufactured separately of the anchor pathway.

16. The system according to any of the preceding Embodiments, further comprising a locking element configured to lock the second anchoring element at the top opening.

17. The system according to any one of the preceding Embodiments, wherein the at least one prefabricated wall is configured to be assembled on top of a bottom prefabricated wall identical to the at least one prefabricated wall, wherein the first anchoring element is constituted by an end of another anchoring element protruding from the bottom prefabricated wall.

18. The system according to Embodiment 17, when dependent on Embodiment 2, wherein the alignment element is configured to be positioned at top opening of anchor pathway of the bottom prefabricated wall, and is configured to align the at least one prefabricated wall onto the bottom prefabricated wall.

19. The system according to Embodiment 18, when dependent on Embodiment 11, wherein the guiding element is configured to be positioned at least partially within the anchor pathway of the bottom prefabricated wall and is configured to guide the end of the other anchoring element constituting the first anchoring element.

20. The system according to Embodiment 19, wherein the alignment element and the guiding element are integrally formed as a single element.

21. The system according to any one of Embodiments 1 to 16, wherein a second end of the second anchoring element is configured to constitute the first anchoring element for another top prefabricated wall identical to the at least one prefabricated wall, and configured to be coupled to another anchoring element and be received in anchor pathway of said other top prefabricated wall.

22. The system according to Embodiment 21, when dependent on Embodiment 2, wherein the alignment element is configured to be positioned at the top opening of the anchor pathway of the at least one prefabricated wall, and is configured to align the other top prefabricated wall onto the at least one prefabricated wall.

23. The system according to Embodiment 22, when dependent on Embodiment 11, wherein the guiding element is configured to be positioned at least partially within the anchor pathway of the at least one prefabricated wall and is configured to guide the second end of the second anchoring element.

24. The system according to Embodiment 23, wherein the alignment element and the guiding element are integrally formed as a single element.

25. The system according to any one of Embodiments 1 to 16, wherein the first anchoring element protrudes from a base support element.

26. The system according to Embodiment 25, when dependent on Embodiment 2, wherein the alignment element is configured to be positioned at the base support element, and is configured to align the at least one prefabricated wall onto the base support element.

27. A system for assembling prefabricated walls, said system comprising:

at least one prefabricated wall having two side portions, a central portion extending therebetween, a bottom portion extending between the side portions and below the central portion, and a top portion extending between the side portions and above the central portion;

a first engaging member configured to be positioned at at least one of the top portion, the bottom portion, and the side portions;

a second engaging member configured to be connected to an external object and to engage the first engaging member; and a fastening element configured to fasten the first and the second engaging member together.

28. The system according to Embodiment 27, wherein at least a portion of one of the first and the second engaging members is configured to be received within the other one of the first and the second engaging members.

29. The system according to Embodiment 27 or 28, wherein one of the first and the second engaging members comprises one or more protrusions and the other one of the first and the second engaging members comprises corresponding one or more recesses configured to receive therewithin the one or more protrusions.

30. The system according to Embodiment 29, wherein said one of the first and the second engaging member comprises a plurality of protrusions, and said other one of the first and the second engaging member comprises an elongated recess configured to receive therewithin the plurality of protrusions.

31. The system according to Embodiment 29, wherein said one of the first and the second engaging member comprises an elongated protrusion configured to extend along a height of the prefabricated wall, and said other one of the first and the second engaging member comprises an elongated recess configured to receive therewithin the elongated protrusion.

32. The system according to any one of Embodiments 29 to 31, wherein the one or more recesses comprise a recess base and two recess sides extending therefrom, the recess sides together with the recess base defining the recess.

33. The system according to any one of Embodiments 27 to 32, wherein the fastening element is an elongated element configured to be at least partially inserted through the first and the second engaging members at least when the first and the second engaging members engage each other.

34. The system according to Embodiment 33, wherein the fastening element is configured to be inserted through the first and the second engaging members in a direction along thickness of the prefabricated wall.

35. The system according to Embodiment 33 or 34, when dependent on Embodiment 32, wherein the fastening element is configured to be inserted through at least one of the recess sides.

36. The system according to any one of Embodiments 27 to 35, wherein the first and the second engaging members comprise respective one or more holes configured to align with each other and to receive therethrough the fastening element, at least when the first and the second engaging members engage each other.

37. The system according to Embodiment 36, wherein at least one of the first and the second engaging members comprises one or more fastener guides corresponding to at least some of the one or more holes, and configured to guide the fastening element through the respective holes.

38. The system according to Embodiment 36 or 37, when dependent on Embodiment 32, wherein at least one of said recess sides comprise said one or more respective holes.

39. The system according to any one of Embodiments 27 to 38, wherein the at least one prefabricated wall comprises markings representing the locations where the fastening element is to be inserted through the at least one prefabricated wall.

40. The system according to any one of Embodiments 27 to 39, wherein the first engaging member is configured to be positioned at one of the two side portions, and the second engaging member is configured to be connected to a side portion of an adjacent prefabricated wall constituting the external object.

41. The system according to Embodiment 40, when dependent on Embodiment 31, wherein said elongated recess has at least one of an open bottom end and an open top end, and is configured to slidingly receive therewithin said elongated protrusion.

42. The system according to any of Embodiments 27 to 39, wherein the first engaging member is configured to be positioned at the bottom portion, and the second engaging member is configured to be connected to a base support element constituting the external object.

43. The system according to any of Embodiments 27 to 39, wherein the first engaging member is configured to be positioned at the top portion, and the second engaging member is configured to be connected to a bottom portion of another top prefabricated wall constituting the external object.

44. The system according to any of Embodiments 27 to 39, wherein the first engaging member is configured to be positioned at the bottom portion, and the second engaging member is configured to be connected to a top portion of another bottom prefabricated wall constituting the external object.

45. The system according to any one of Embodiments 27 to 44, wherein the at least one prefabricated wall further comprises:

a front face and an opposite back face, a majority of the front and the back faces constituting the central portion; and two side faces extending between said front face and said back face, said two side faces extending together with said front face and said back face between a bottom face and a top face of the prefabricated wall, each of the side portions including a respective one of the two side faces and respective side parts of the front face and the back face, the bottom portion including the bottom face and bottom parts of the front face and the back face, and the top portion including the top face and top parts of the front face and the back face;

wherein the first engaging member is positioned at at least one of the bottom face, the top face, and the side faces.

46. The system according to Embodiment 45, when dependent on Embodiment 7, wherein the fastening element is configured to be inserted through the first and the second engaging members in a direction extending between the front face and the back face.

47. The system according to Embodiment 46, wherein the fastening element is configured to be inserted through the first and the second engaging members in a direction perpendicular to at least one of the front face and the back face.

48. The system according to any one of Embodiments 45 to 47, when dependent on Embodiment 40, wherein the first engaging member is configured to be positioned at one of the two side faces, and the second engaging member is configured to be connected to a side face of the adjacent prefabricated wall constituting the external object.

49. The system according to any one of Embodiments 45 to 47, when dependent on Embodiment 42, wherein the first engaging member is configured to be positioned at the bottom face.

50. The system according to any one of Embodiments 45 to 47, when dependent on Embodiment 43, wherein the first engaging member is configured to be positioned at the top face, and the second engaging member is configured to be connected to a bottom face of said other top prefabricated wall constituting the external object.

51. The system according to any one of Embodiments 45 to 47, when dependent on Embodiment 44, wherein the first engaging member is configured to be positioned at the bottom face, and the second engaging member is configured to be connected to a top face of said other bottom prefabricated wall constituting the external object.

BRIEF DESCRIPTION OF THE DRAWINGS

In order to better understand the subject matter that is disclosed herein and to exemplify how it may be carried out in practice, embodiments will now be described, by way of non-limiting example only, with reference to the accompanying drawings, in which.

DETAILED DESCRIPTION OF EMBODIMENTS

Figure 1A:
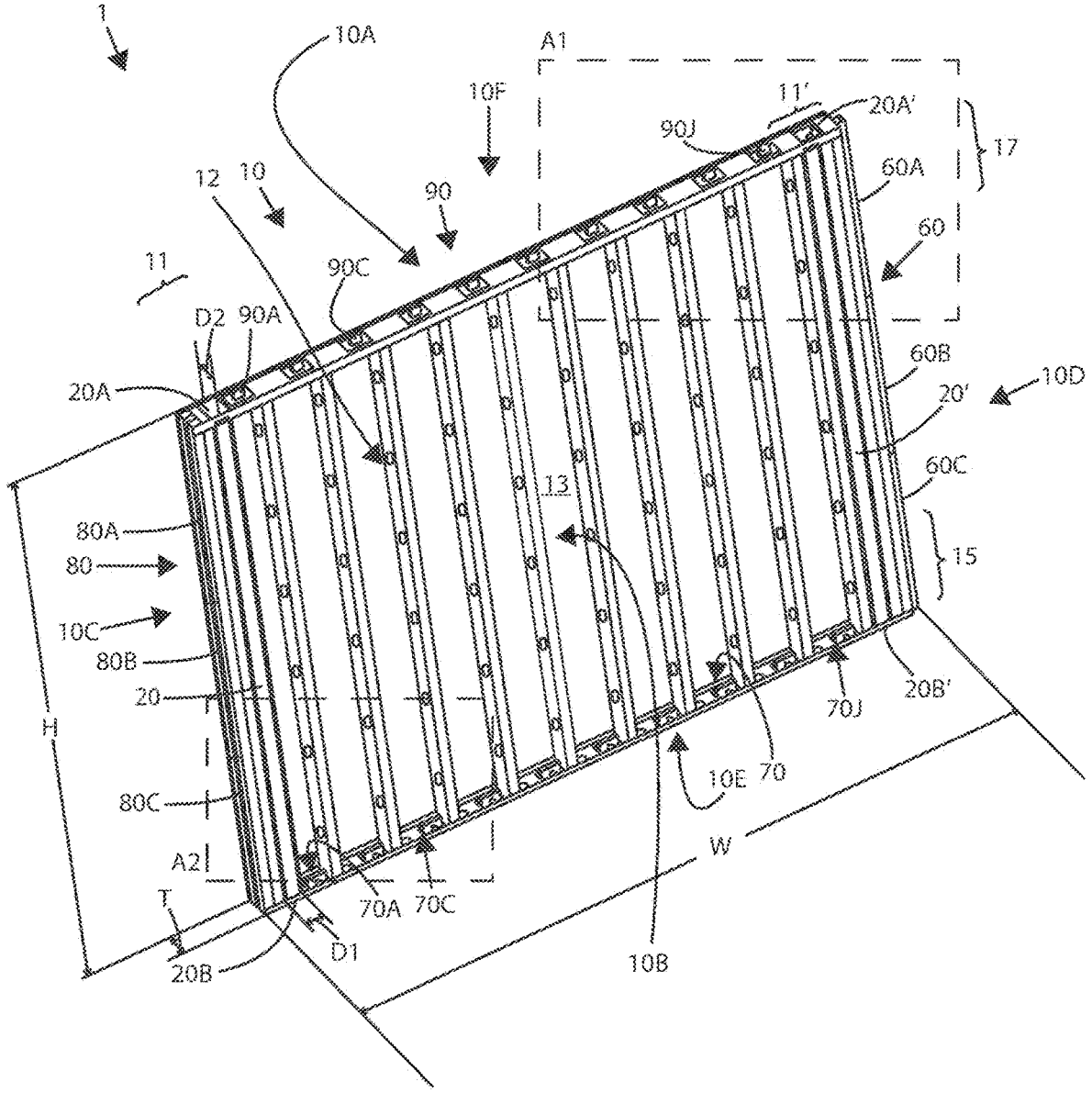
FIG. 1A illustrates a top perspective view of a prefabricated wall with its resistance and finishing layer removed from one of its side, according to an example of the presently disclosed subject matter.
Figure 1B:
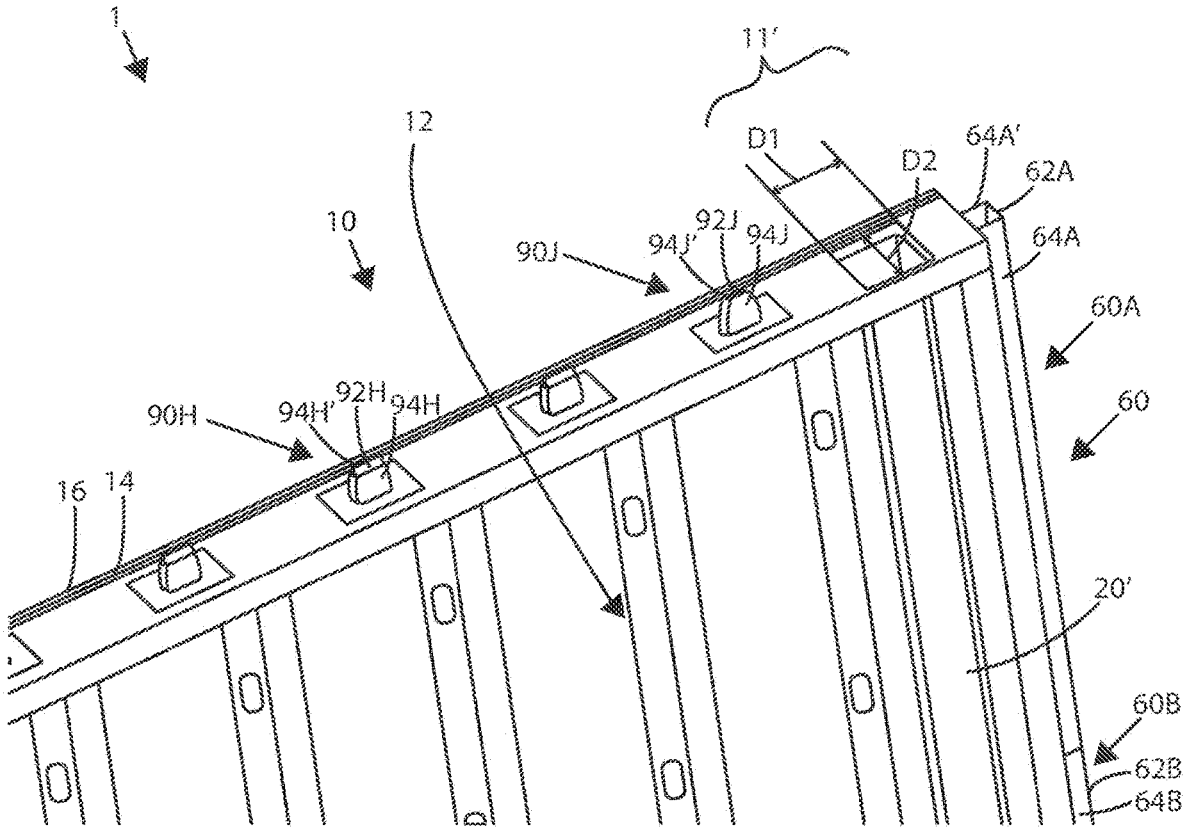
FIG. 1B illustrates an enlarged view of section A1 shown in FIG. 1A.
Figure 1C:
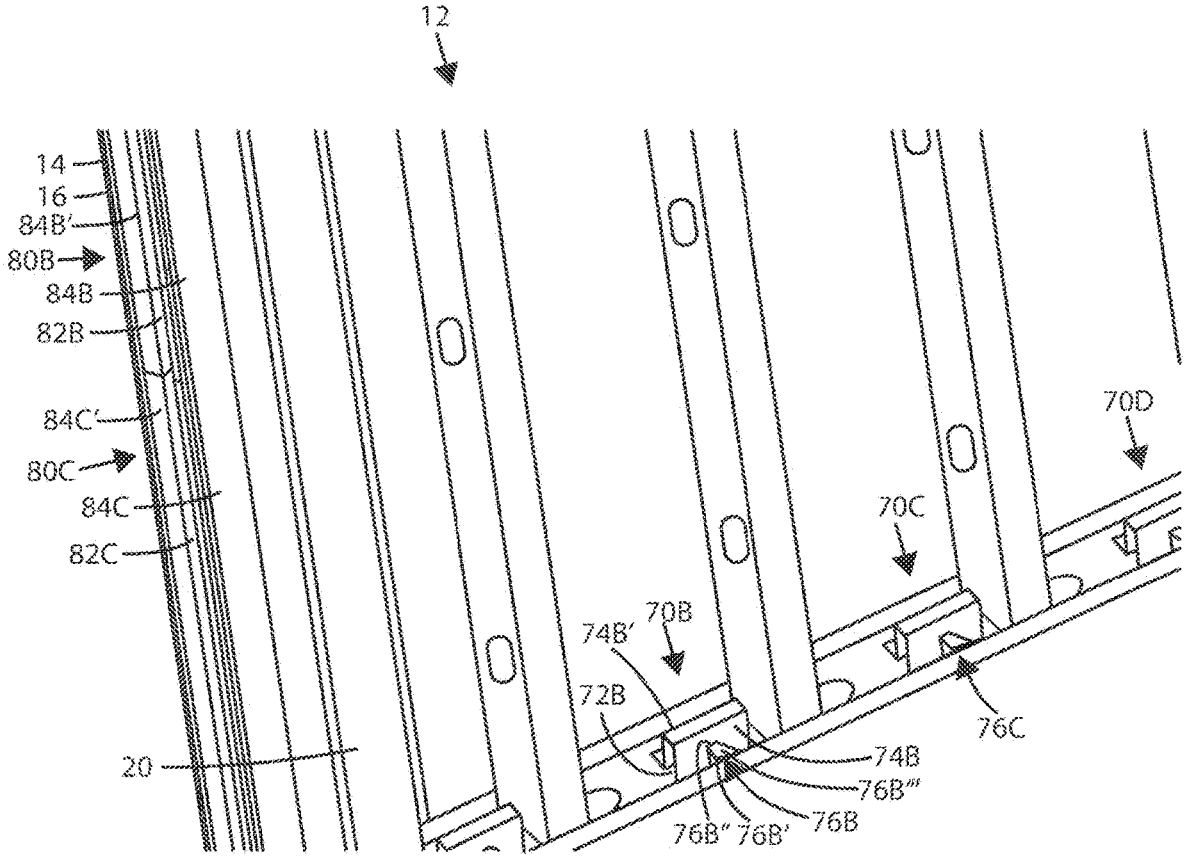
FIG. 1C illustrates an enlarged view of section A2 shown in FIG. 1A.
Figure 1D:
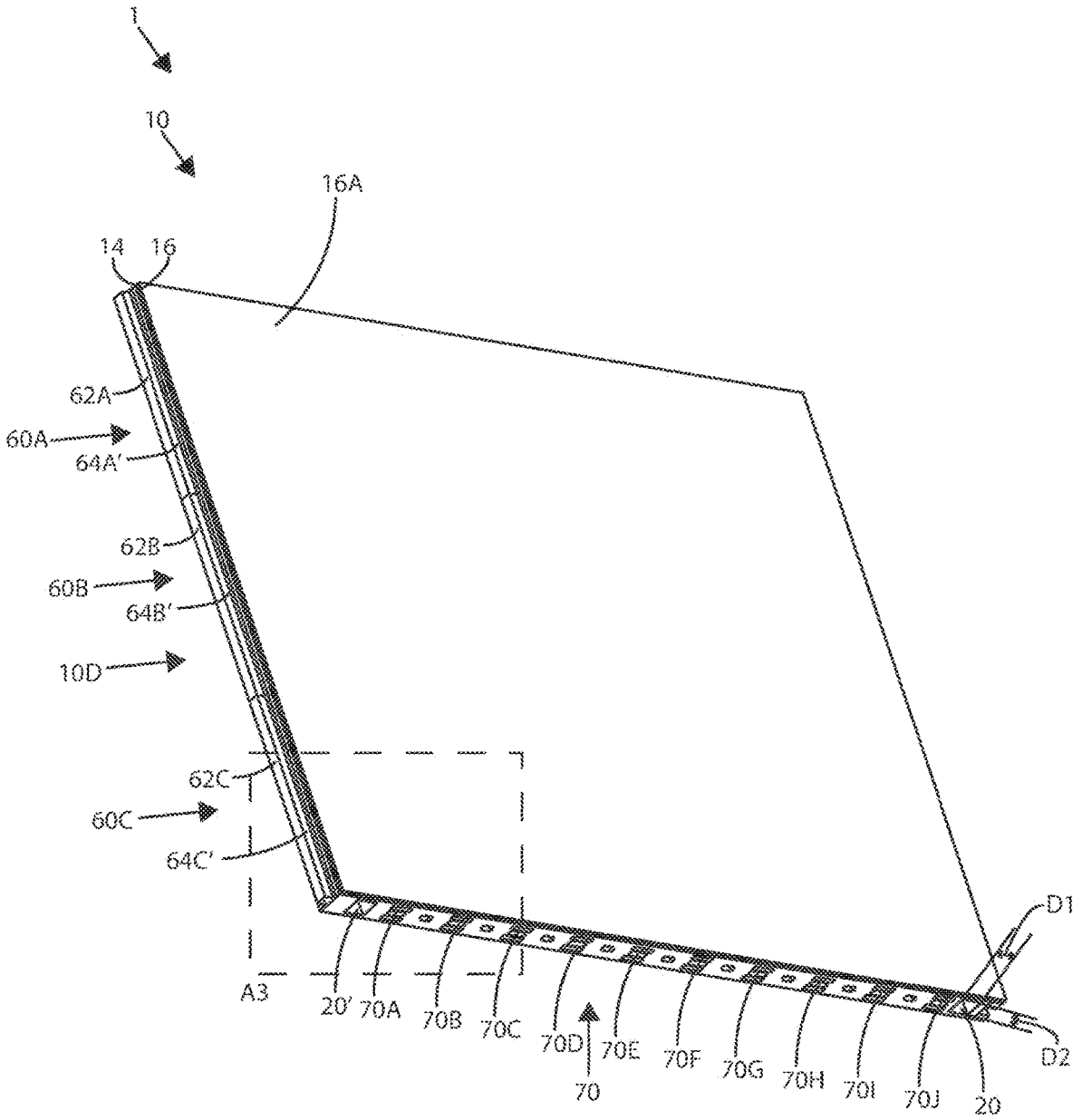
FIG. 1D illustrates a bottom perspective view of the prefabricated wall of FIG. 1A from an opposite side to that shown in FIG. 1A.
Figure 1E:
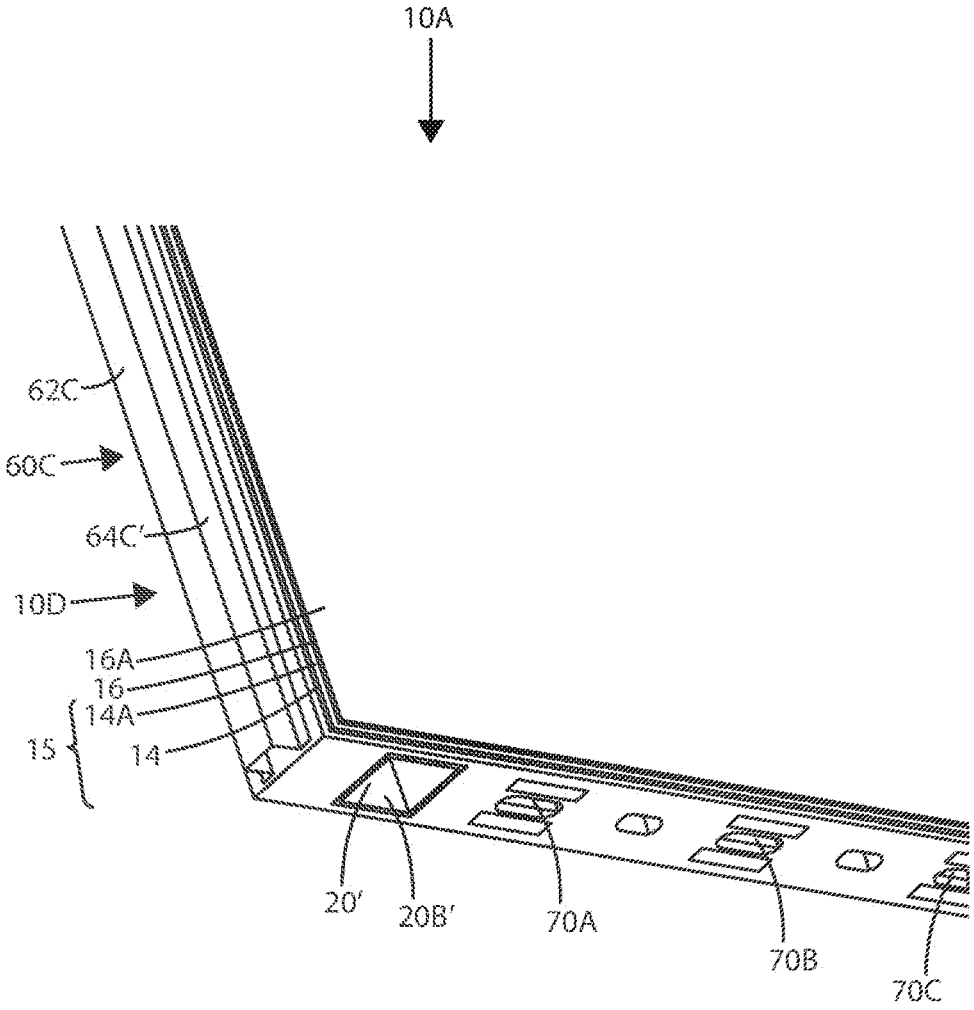
FIG. 1E illustrates an enlarged view of section A3 shown in FIG. 1D.

Reference is now made to FIGS. 1A-1E which are schematic illustrations of a prefabricated wall 10 as a part of a system for assembling prefabricated walls according to an example of the first aspect of the presently disclosed subject matter, generally designated as 1. The prefabricated wall 10 comprises a frame structure 12 having a resistance layer 14 connected to a face thereof, and a finishing layer 16 connected to an exterior surface 14A of the resistance layer 14. The resistance layer and finishing layer from another opposite face of the frame structure have been removed for illustration purposes. A factory finished exterior surface 16A of the finishing layer 16 constitutes a front face 10A of the prefabricated wall. The factory finished exterior surface of the opposite finishing layer (not shown) constitutes a back face 10B of the prefabricated wall. The prefabricated wall 10 includes two side portions 11 and 11', a central portion 13 constituted by portions of the front face 10A and back face 10B, a bottom portion 15, and a top portion 17. The side portions 11 and 11' include respective side faces constituting the side faces 10C and 10D of the prefabricated wall extending between the front face 10A and back face 10B. The bottom portion 15 includes a bottom face 10E of the prefabricated wall 10 and the top portion 17 includes a top face 10F of the prefabricated wall 10, such that the two side faces 10C and 10D extend together with the front face 10A and the back face 10B between the bottom face 10E and the top face 10F.

The prefabricated wall has anchor pathways 20 and 20' extending therethrough along a height H of the prefabricated wall and each between respective top openings 20A and 20A', formed in the top face 10F and respective bottom openings 20B and 20B' formed in the bottom face 10E. In the illustrated example, the prefabricated wall 10 has a width W significantly longer than a thickness T thereof, and there are two anchor pathways 20 and 20' extending through side portions 11 and 11'. The anchor pathway 20 has a first dimension D1 in a direction along the width W of the prefabricated wall 10, and a second dimension D2 in a direction along the thickness T of the prefabricated wall 10. In the illustrated example, the anchor pathway 20 has uniform dimensions D1 and D2 throughout the length of the anchor pathway 20 along the height H of the prefabricated wall 10. In other examples, the top opening 20A and the bottom opening 20B can have different dimensions than the rest of the anchor pathway. For instance, the top opening 20A and the bottom opening 20B can be narrower than the rest of the anchor pathway 20.

In some examples (not shown), the prefabricated wall can be in the form of a column having thickness and width substantially similar, and can have only one anchor pathway extending therethrough.

Figure 2A:
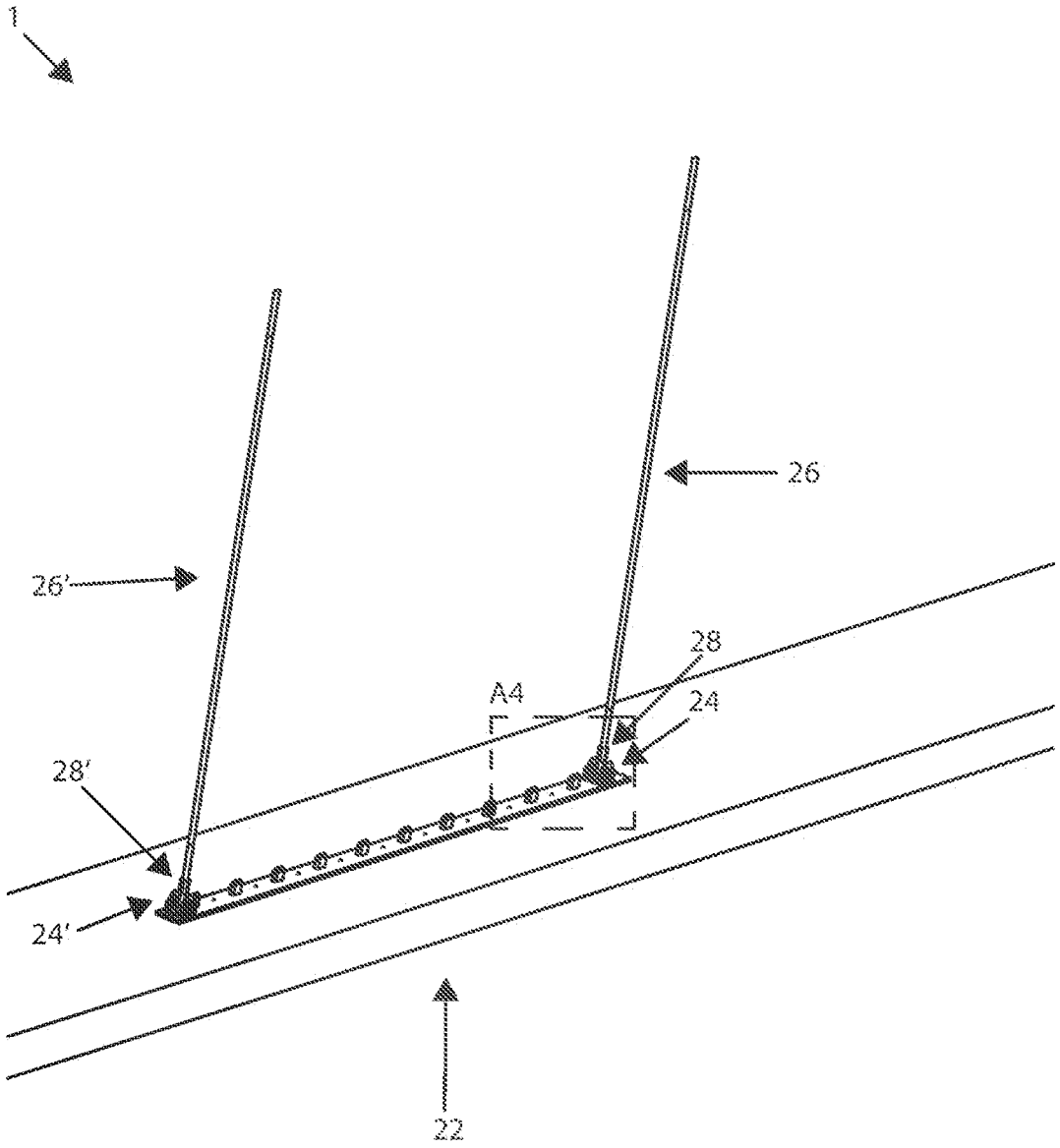
FIG. 2A illustrates a perspective view of a system for assembling prefabricated walls with some of its elements connected to a base support element, according to an example of the presently disclosed subject matter.

Reference is now made to FIGS. 2A-2E which are schematic illustrations of system 1 depicting assembling of the prefabricated wall 10. FIG. 2A shows a base support element 22 having a first anchoring element 24 with its first end 24A connected thereto. A second end 24B of the first anchoring element 24 is coupled to first end 26A of a second anchoring element 26 via a coupler 28. The coupler 28 can be a coupler nut having two threaded portions at two ends each configured to be coupled to the first and the second anchoring elements respectively. Although FIG. 2A depicts another first anchoring element 24', another second anchoring element 26' and another coupler 28' with same features as those of the first anchoring element 24, second anchoring element 26 and coupler 28, only the first anchoring element 24, second anchoring element 26 and coupler 28 have been described in detailed for the purpose of clarity.

Figure 2B:
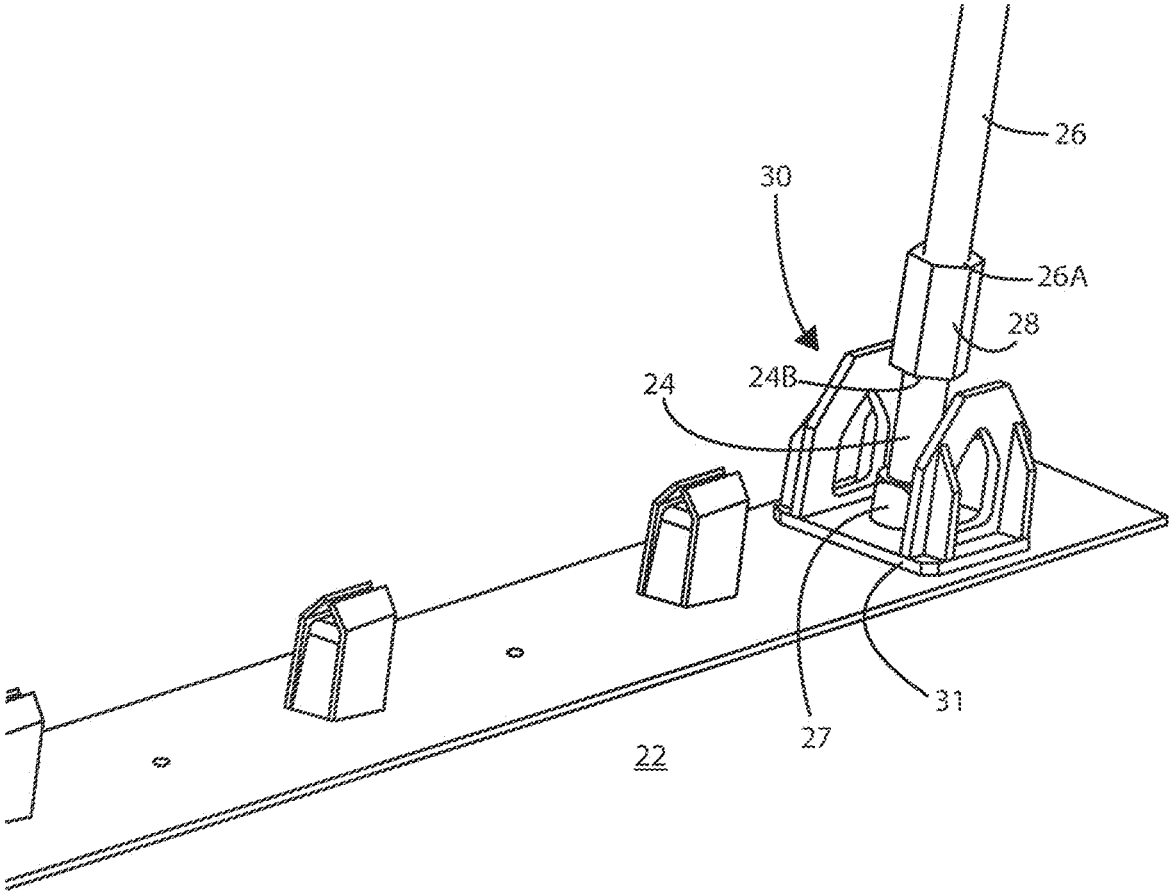
FIG. 2B illustrates an enlarged view of section A4 shown in FIG. 2A.

As can be seen in FIG. 2B, the system 1 further includes an alignment element 30 connected to the base support element 22 such that the first anchoring element 24 passes through a base portion 31 of the alignment element 30 and is locked at the alignment element 30 by a lock nut 27. The alignment element 30 is configured to be received into and align the bottom opening 20B and thus the prefabricated wall 10 into its exact position while it is lowered, as detailed further herein below.

Figure 2C:
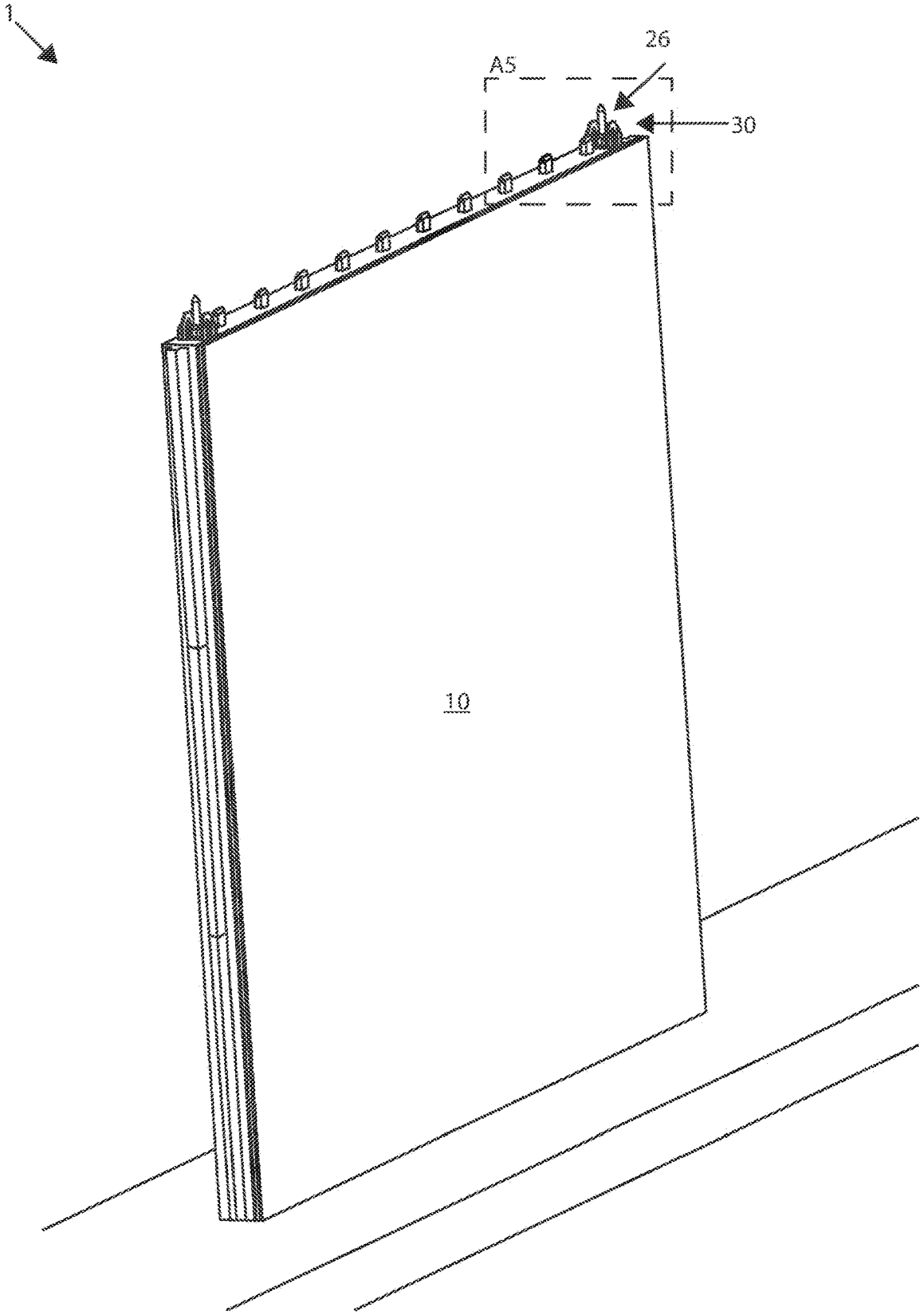
FIG. 2C illustrates a perspective view of the system of FIG. 2A, with some more of its elements.
Figure 2D:
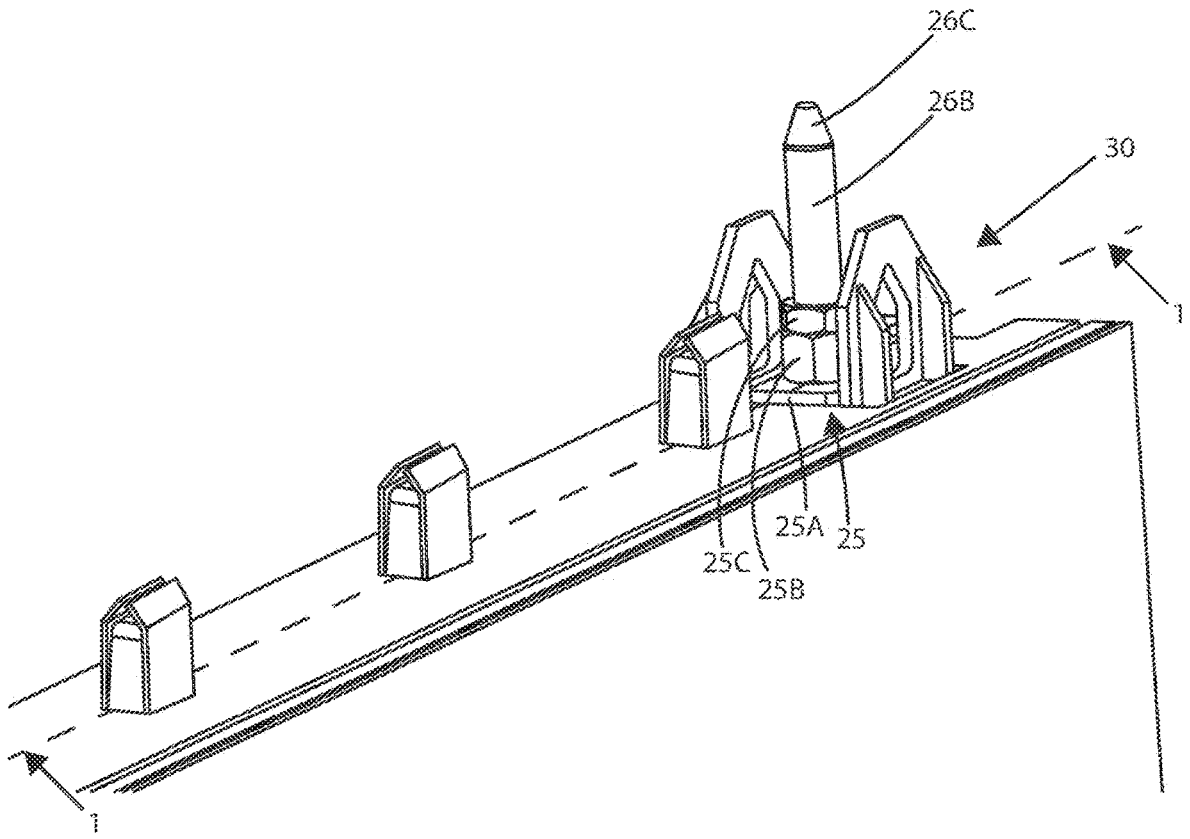
FIG. 2D illustrates an enlarged view of section A5 shown in FIG. 2C.
Figure 2E:
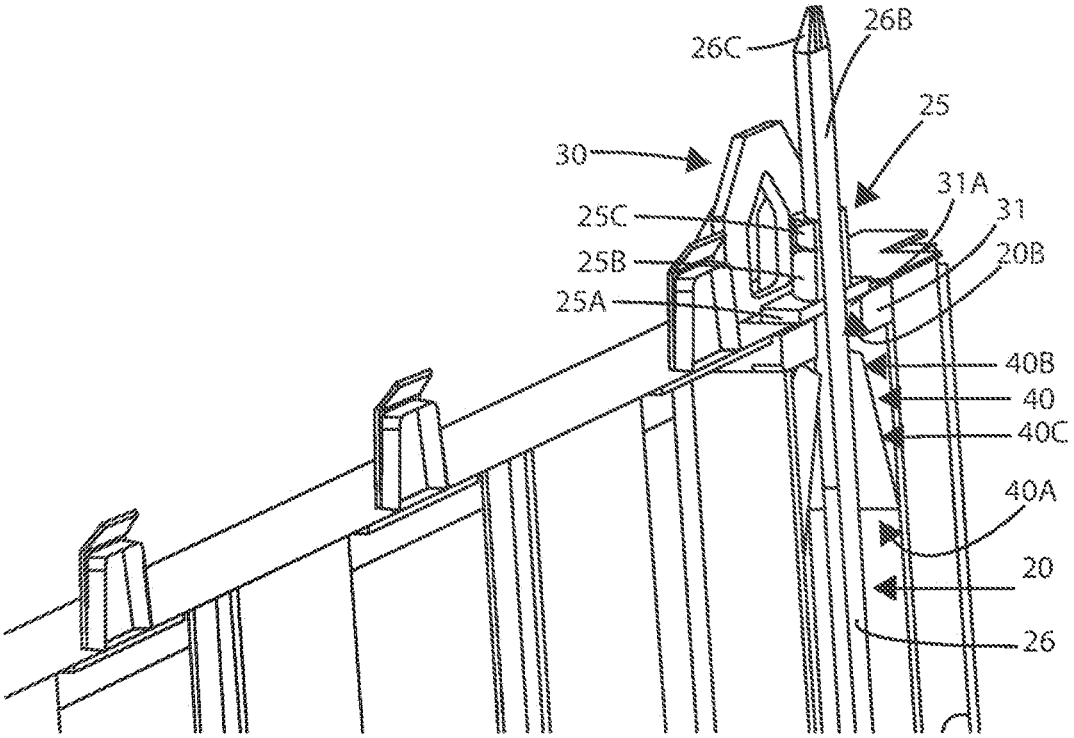
FIG. 2E illustrates a cross-sectional view taken along line 1-1 shown in FIG. 2D.

FIG. 2C depicts the system 1 with the prefabricated wall 10 having been lowered onto the base support element 22 while slidingly receiving the first anchoring element 24, the first end 26A of the second anchoring element 26, and the coupler 28 within the anchor pathway 20 through the bottom opening 20B. As can be best seen in FIGS. 2D and 2E, a second end 26B of the second anchoring element 26 protrudes from the top opening 20A of the anchor pathway 20.

The system 1 includes another alignment element 30 positioned at the top opening 20A of the anchor pathway 20 such that a through-opening 31A formed in the base portion 31 of the alignment element 30 is aligned with the top opening 20A. The second end 26B of the second anchoring element 26 passes through the through-opening 31A and is locked at the top opening 20A by a locking element 25. The locking element 25 includes a washer plate 25A placed over the base portion 31 of the alignment element 30, a lock nut 25B and a jam nut 25C. The second end 26B of the second anchoring element 26 can constitute a first anchoring element for another top prefabricated wall to be received on the top of the prefabricated wall 10, and the other alignment element 30 positioned at the top opening 20A can be configured to align the bottom opening of the anchor pathway of the other top prefabricated wall. The second end 26B of the second anchoring element 26 has a guiding tip 26C removably connected thereto and configured to assist the guiding of the second end 26C through the anchor pathway 20, the top opening 20A, and the through-opening 31A.

The system 1 further includes a guiding element 40 positioned within the anchor pathway 20 in proximity to the top opening 20A. The guiding element 40 has a lower end portion 40A, an upper end portion 40B narrower than the lower end portion 40A and positioned adjacent and aligned with the top opening 20A and the through-opening 31A of the alignment element 30, and an intermediate portion 40C extending between the lower end portion 40A and the upper end portion 40B.

Figure 3A:
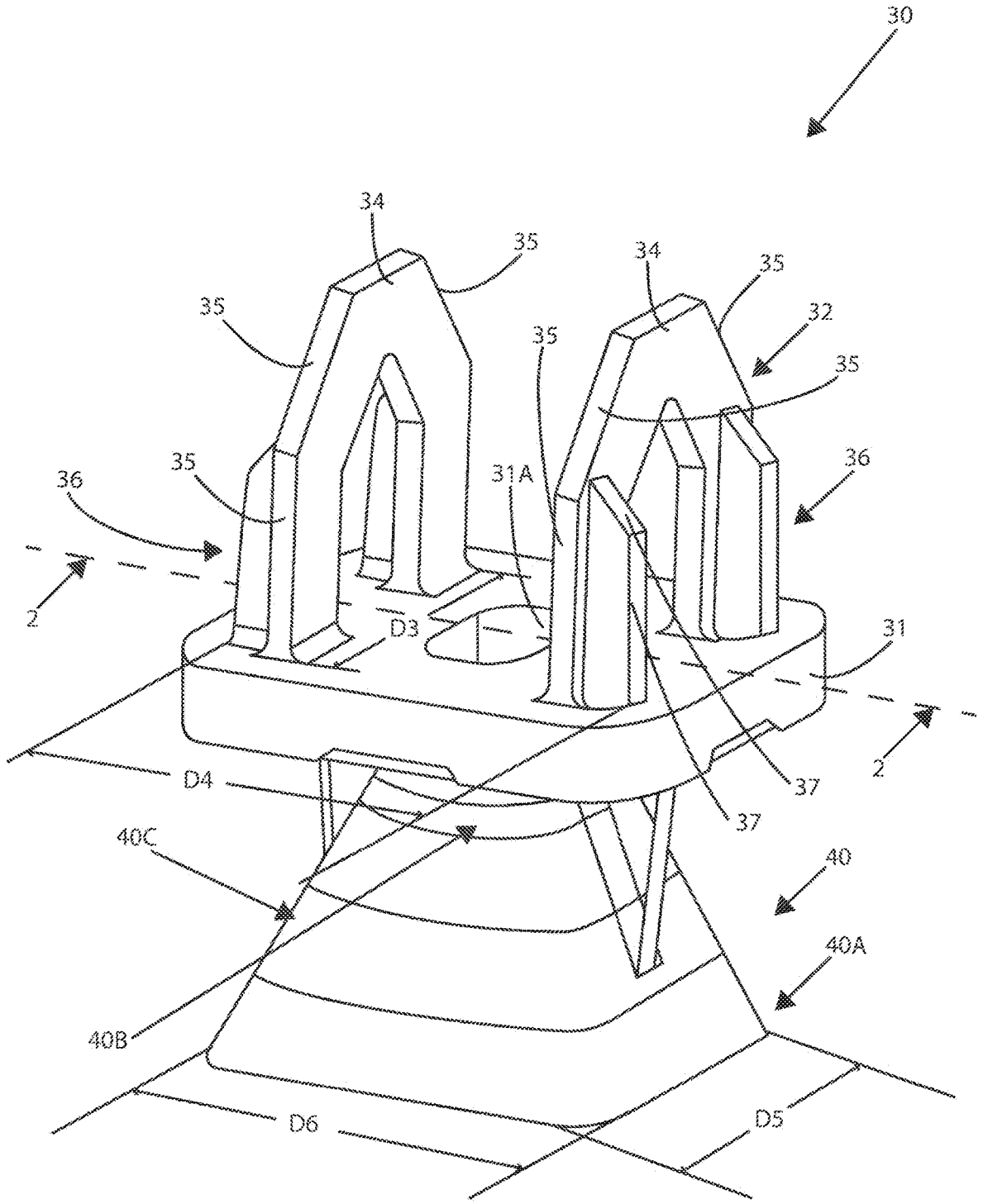
FIG. 3A illustrates a perspective view of an alignment element and guiding element integrally formed, according to an example of the presently disclosed subject matter.
Figure 3B:
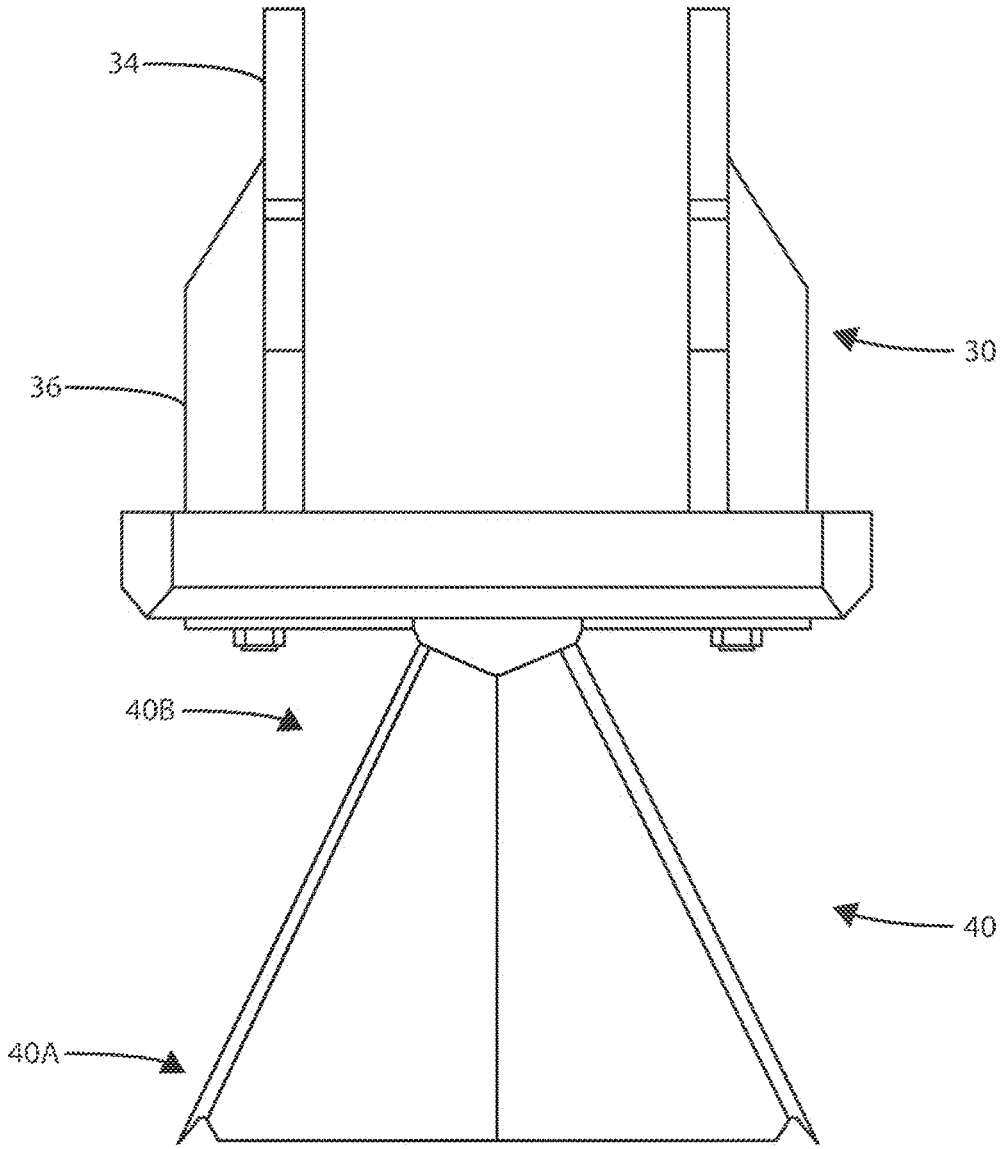
FIG. 3B illustrates a perspective view of an alignment element and guiding element separately formed and connected together, according to another example of the presently disclosed subject matter.
Figure 3C:
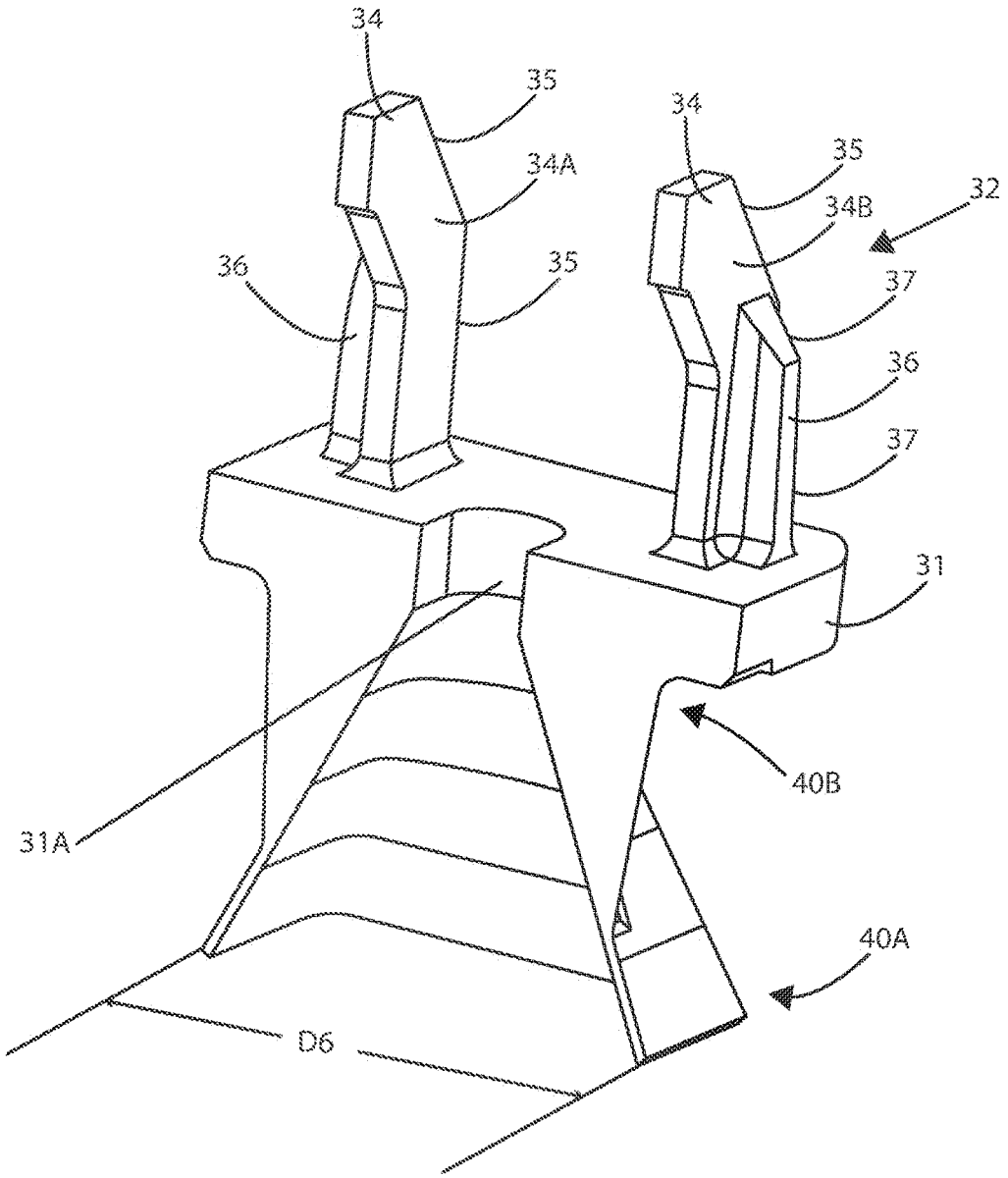
FIG. 3C illustrates a cross-sectional view taken along line 2-2 shown in FIG. 3A.

Reference is now made to FIGS. 3A-3C to describe in detail the structure of the alignment element 30 and guiding element 40 according to an example of the presently disclosed subject matter. FIGS. 3A and 3C illustrate the alignment element 30 and the guiding element 40 integrally formed with each, whereas FIG. 3B illustrates the alignment element 30 and the guiding element 40 having been manufactured separately and connected together. The alignment element 30 has the base portion 31 having the through-opening 31A, and an aligning portion 32 extending from the base portion 31. The aligning portion 32 includes two main aligning plates 34 extending from and perpendicular to the base portion 31. The main aligning plates 34 have edges 35 converging in a direction away from the base portion 31. The slope of the convergence is a gradient slope. In other examples, this slope can be a constant slope. A maximum distance D3 between the edges 35 of each of the main aligning plates 34 corresponds to respective dimension of the bottom opening 20B, which in the illustrated example is D1. When the prefabricated wall 10 is being lowered, or during upliftment of the prefabricated wall 10 in a seismic event, the bottom opening 20B slides on the edges 35 and gets aligned precisely over the alignment element 30 in the direction along the width W of the prefabricated wall 10. Each main aligning plate 34 has internal surface 34A, and opposite external surface 34B having auxiliary aligning plates 36 extending perpendicularly therefrom. The auxiliary aligning plate 36 has edge 37 sloped away from the main guiding plate 34 in a direction towards the base portion 31 of the aligning element 30. The slope of the edge 37 is a gradient slope. In other examples, the slope of the edge 37 can be a constant slope. A maximum distance D4 between the edges 37 of the auxiliary aligning plates 36 of the two main aligning plates 34 corresponds to respective dimension of the bottom opening 20B, which in the illustrated example is D2. When the prefabricated wall 10 is being lowered, or during upliftment of the prefabricated wall 10 in a seismic event, the bottom opening 20B slides on the edges 37 and gets aligned precisely over the alignment element 30 in the direction along the thickness T of the prefabricated wall 10.

The lower end portion 40A of the guiding element 40 has a dimension D5 along the width W of the prefabricated wall 10, that corresponds to the respective dimension of the anchor pathway 20, i.e., D1. The lower end portion 40A of the guiding element 40 has a dimension D6 along the thickness T of the prefabricated wall 10, that corresponds to the respective dimension of the anchor pathway 20, i.e., D2. As can be seen the best in FIG. 3C, the upper end portion 40B of the guiding element 40 has dimensions that corresponds to those of the through-opening 31A of the alignment element 30. In examples where the top opening 20A is narrower than rest of the anchor pathway 20, the dimensions of the upper end portion 40B of the guiding element 40 corresponds to those of the top opening 20A. While the prefabricated wall 10 is being lowered, the dimensions of the guiding element 40 causes the guiding element 40 to guide the second end 26B of the second anchoring element 26 through the top opening 20A and the through-opening 31A of the alignment element 30.

Figure 3D:
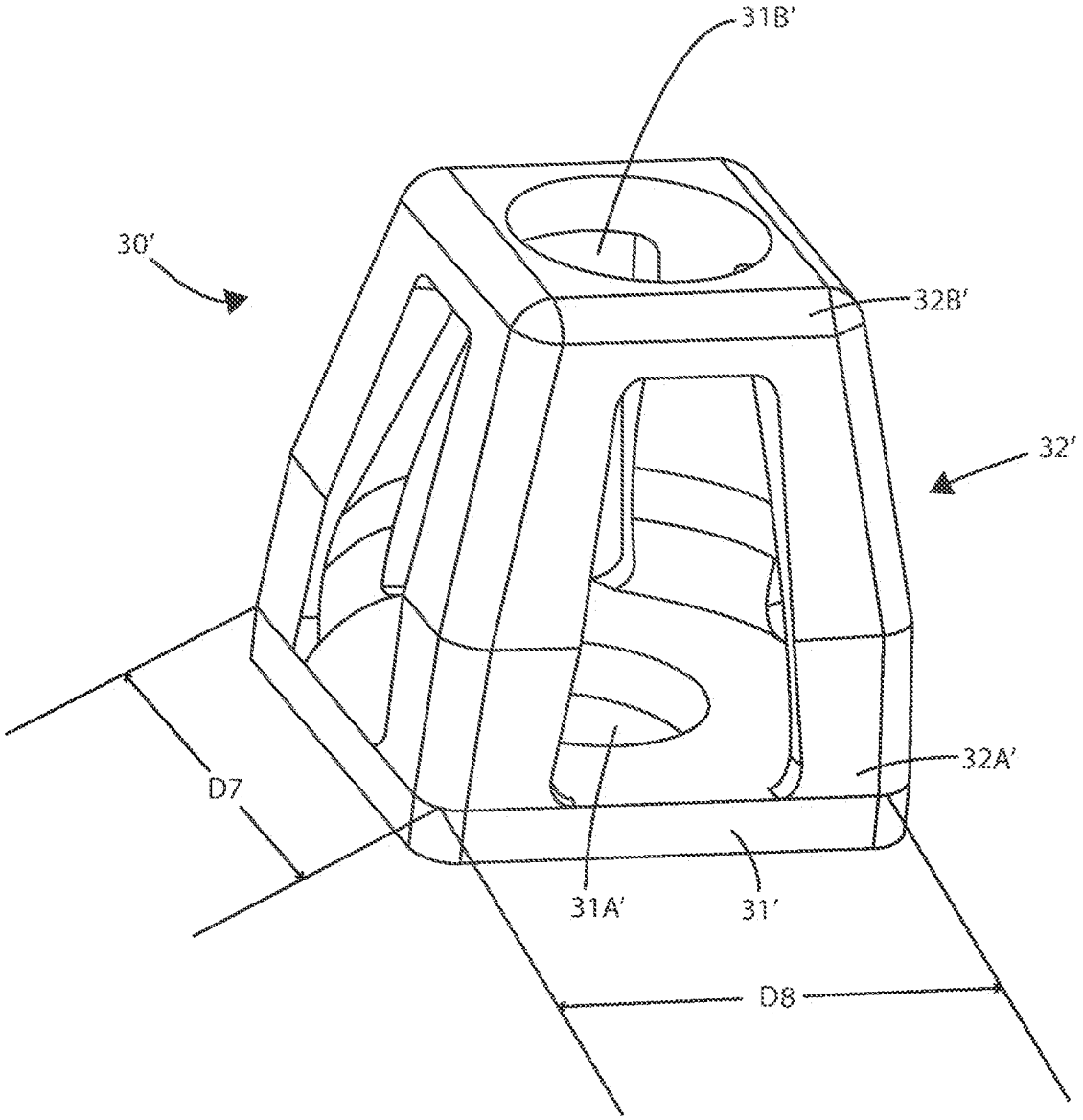
FIG. 3D illustrates a perspective view of an alignment element, according to an example of the presently disclosed subject matter.

FIG. 3D illustrates an alignment element 30' according to another example of the presently disclosed subject matter. The alignment element comprises a base portion 31' having a through-opening 31A', and an aligning portion 32' extending from the base portion 31'. The aligning portion 32' has a bottom end 32A' connected to the base portion 31' and having a dimension D7 to be positioned along the width W of the prefabricated wall that corresponds to the respective dimension of the anchor pathway 20, i.e., D1. The bottom end 32A' has a dimension D8 to be positioned along the thickness T of the prefabricated wall that corresponds to the respective dimension of the anchor pathway 20, i.e., D2. The aligning portion 32' converges in a direction away from the base portion 31' such that a top end 32B' thereof is narrower than the bottom end 32A'. The slope of the convergence is gradient slope. In other examples, the slope can be a constant slope. When the prefabricated wall 10 is lowered, the slope of the aligning portion causes the bottom opening 20B to be aligned precisely with the alignment element 31'. The top end 32B' has a through-opening 31B' configured to allow the first anchoring element 24 and/or the second anchoring element 26 to pass therethrough.

Figure 4A:
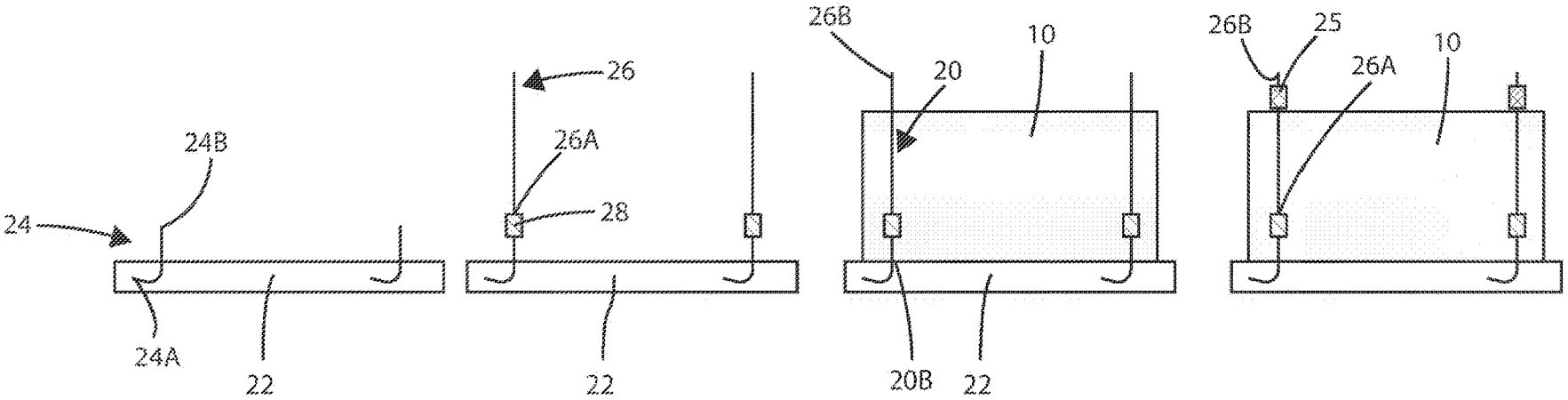
FIG. 4A illustrates a sequence of assembly of prefabricated wall according to an example of the presently disclosed subject matter.

FIG. 4A schematically illustrates a sequence of assembling the prefabricated wall 10, according to an example of the presently disclosed subject matter. As shown in FIG. 4A, first of all the first anchoring elements 24 are connected to the base support element 22 followed by coupling the second anchoring elements 26 thereto via the couplers 28. After installing the first and the second anchoring element, the prefabricated wall 10 is lowered onto the base support element 22 while receiving the second end 26B of the second anchoring element 26, the coupler 28 and the first anchoring element 24 into the anchor pathway 20 via the bottom opening 20B. Then the second end 26B of the second anchoring element 26 is locked at the top opening 20A by the locking element 25.

Figure 4B:
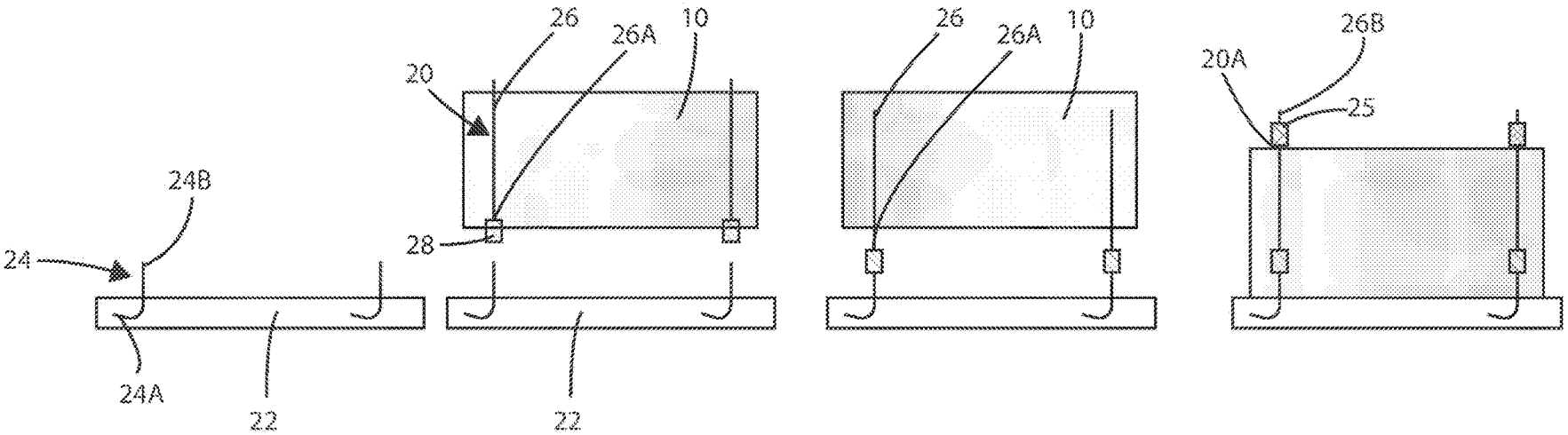
FIG. 4B illustrates a sequence of assembly of prefabricated wall according to another example of the presently disclosed subject matter.
Figure 4C:
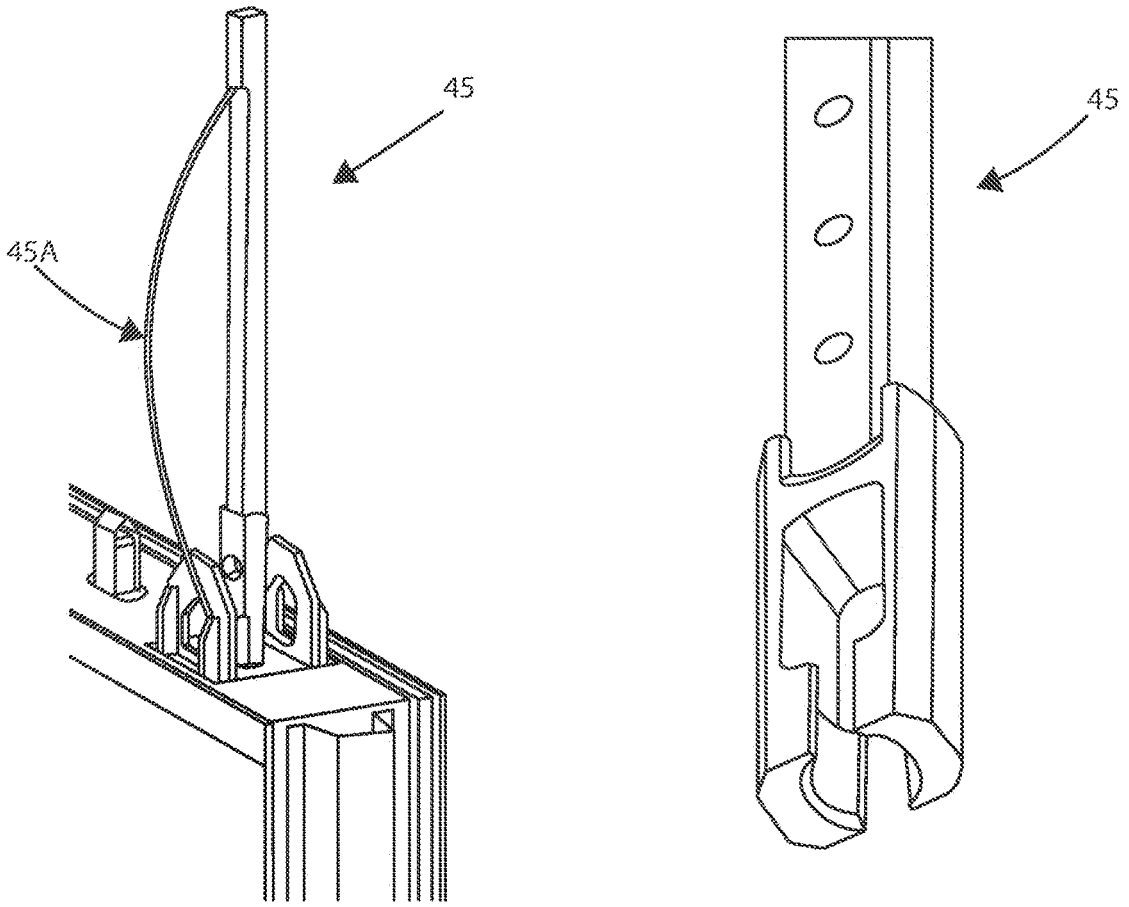
FIG. 4C illustrates a special tool for assembly of prefabricated wall according to the example shown in FIG. 4B.

FIG. 4B schematically illustrates a sequence of assembling the prefabricated wall 10, according to another example of the presently disclosed subject matter. As shown in FIG. 4B, first of all the first anchoring elements 24 are connected to the base support element 22. The second anchoring element 26 with the coupler 28 connected to the first end 26A thereof is inserted into the anchor pathway 20. Then the prefabricated wall 10 is lowered up to just above the first anchoring element 24, and the second anchoring element 26 is lowered so as to be coupled to the first anchoring element 24. After coupling the second anchoring element 26 and the first anchoring element 24, the prefabricated wall 10 is completely lowered onto the base support element 22. Then the second end 26B of the second anchoring element 26 is locked at the top opening 20A by the locking element 25. As shown in FIG. 4C, the second anchoring element 26 can be lowered and coupled to the first anchoring element 24 by a special tool 45 connected to the second end 26B of the second anchoring element 26. The tool 45 can be used to thread the second anchoring element 26 with the first anchoring element 24 via the coupler 28, and then can be disconnected from the second anchoring element 26. The tool 45 has a safety cable 45A configured to secure the tool 45 to the prefabricated wall 10 during operation thereof.

In some examples of any of the alternative sequences, an alignment element (not shown) can be positioned at the base support element 22 after connecting the first anchoring element 24 and prior to coupling the second anchoring element 26 thereto. In some examples of any of the alternative sequences, a guiding element (not shown) can be positioned in the anchor pathway 20 in proximity to the top opening 20A prior to lowering the prefabricated wall 10. In some examples of any of the alternative sequences, an alignment element (not shown) can be positioned at the top opening 20A either prior to or after lowering the prefabricated wall 10, but prior to locking the second end 26B.

Although the above description has been provided with reference to one prefabricated wall 10, it is to be understood that in the similar manner, more prefabricated walls can be assembled one above other, and the above description applies to such an assembly. The prefabricated wall 10 can be the bottom most wall of the whole assembly, a middle wall, or can be a top wall configured to be assembled in the similar manner on the top of a bottom prefabricated wall. The first anchoring element and the alignment element for the bottom most wall is connected to the base support element. The second end of second anchoring element of every bottom wall constitutes a first anchoring element for its top wall. The alignment element positioned on top of every bottom wall constitutes the anchoring element for aligning its top wall. All the prefabricated walls have to be identical at least in the manner to have the anchor pathways similar to the anchor pathway 20 described above.

Reference is now made again to FIGS. 1A-1E for describing the system 1 according to the second aspect of the presently disclosed subject matter. The system 1 further comprises a first engaging member 60 connected to a side face 10D of the prefabricated wall 10. The first engaging member 60 includes three protrusions 60A, 60B, and 60C extending from the side face 10D. The protrusions 60A-C can be integrally formed with the frame structure 12 or can be separately manufactured and mounted to the frame structure 12. In some examples, the first engaging member 60 can be just one protrusion extending along the height H of the prefabricated wall 10. Each of the protrusions 60A-60C has respective protrusion tops 62A-62C and two protrusion sides 64A-64C and 64A'-64C' extending between the prefabricated wall 10 and the protrusion tops 62A-62C.

The system 1 further includes another first engaging member 70 connected to the bottom portion 15 of the prefabricated wall 10. The other first engaging member 70 includes a plurality of recesses 70A-70J extending into the prefabricated wall 10 from the bottom face 10E. The recesses 70A-70J can be integrally formed with the frame structure 12 or can be separately manufactured and then mounted to the frame structure 12. In some examples, the other first engaging member 70 can be just one elongated recess extending along the width W of the prefabricated wall 10. The recesses 70A-70J have respective recess bases 72A-72J and two recess sides 74A-74J and 74A'-74J' extending from the recess bases 72A-72J. The recesses 70A-70J have respective holes on the recess sides, and corresponding fastener guides 76A-76J having wide end portions 76A'-76J' facing the resistance layer 14, narrow end portions 76A"-76J" aligned with the holes, and intermediate portions 76A'"-76J'" (best seen in FIG. 6B) extending therebetween.

The system 1 further includes a second engaging member 80 connected to the side face 10C of the prefabricated wall 10. For the simplicity of description, the second engaging member 80 is described with reference to the prefabricated wall 10, and the second engaging member 80 is configured to be connected to an adjacent wall and to engage with the first engaging member 60, as detailed herein below with reference to FIGS. 5A and 5B. In other words, the second engaging member 80 is configured to engage a first engaging member connected to an adjacent prefabricated wall to be assembled adjacent the prefabricated wall 10.

The second engaging member 80 includes three recesses 80A, 80B, and 80C connected to the side face 10C. The recesses 80A-C can be integrally formed with the frame structure 12 or can be separately manufactured and mounted to the frame structure 12. In some examples, the second engaging member 80 can be just one recess extending along the height H of the prefabricated wall 10. Each of the recesses 80A-80C has respective recess bases 82A-82C and two recess sides 84A-84C and 84A'-84C' extending from the recess bases 82A-82C.

The system 1 further includes another second engaging member 90 connected to the top face 10F of the prefabricated wall 10. For the simplicity of description, the second engaging member 90 is described with reference to the prefabricated wall 10, and the second engaging member 90 is configured to be connected to either a bottom wall or the base support element 22 and to engage with the other first engaging member 70, as detailed herein below with reference to FIGS. 6A and 6B. In other words, the other second engaging member 90 is configured to engage the other first engaging member connected to a top prefabricated wall to be assembled on top of the prefabricated wall 10.

The other second engaging member 90 includes a plurality of protrusions 90A-90J extending from the top face 10F of the prefabricated wall 10. The protrusions 90A-90J can be integrally formed with the frame structure 12 or can be separately manufactured and then mounted to the frame structure 12. In some examples, the other second engaging member 90 can be just one elongated protrusion extending along the width W of the prefabricated wall 10. The protrusions 90A-90J have respective protrusion tops 92A-92J and two protrusion sides 94A-94J and 94A'-94J' extending between the prefabricated wall 10 and the protrusion tops 92A-92J.

Figure 5A:
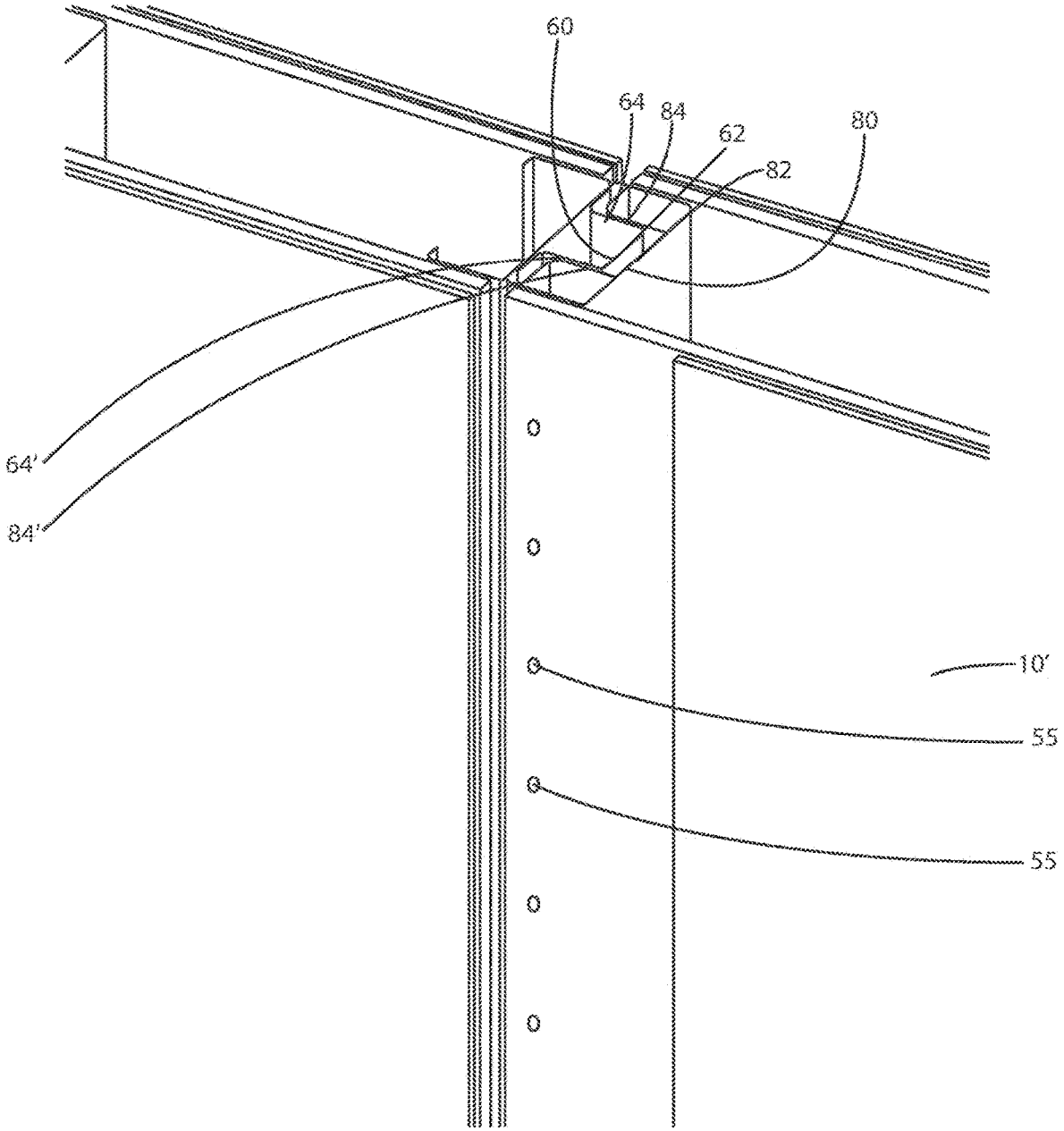
FIG. 5A illustrates a top perspective view of two adjacent prefabricated walls with first and second engaging members engaging each other.
Figure 5B:
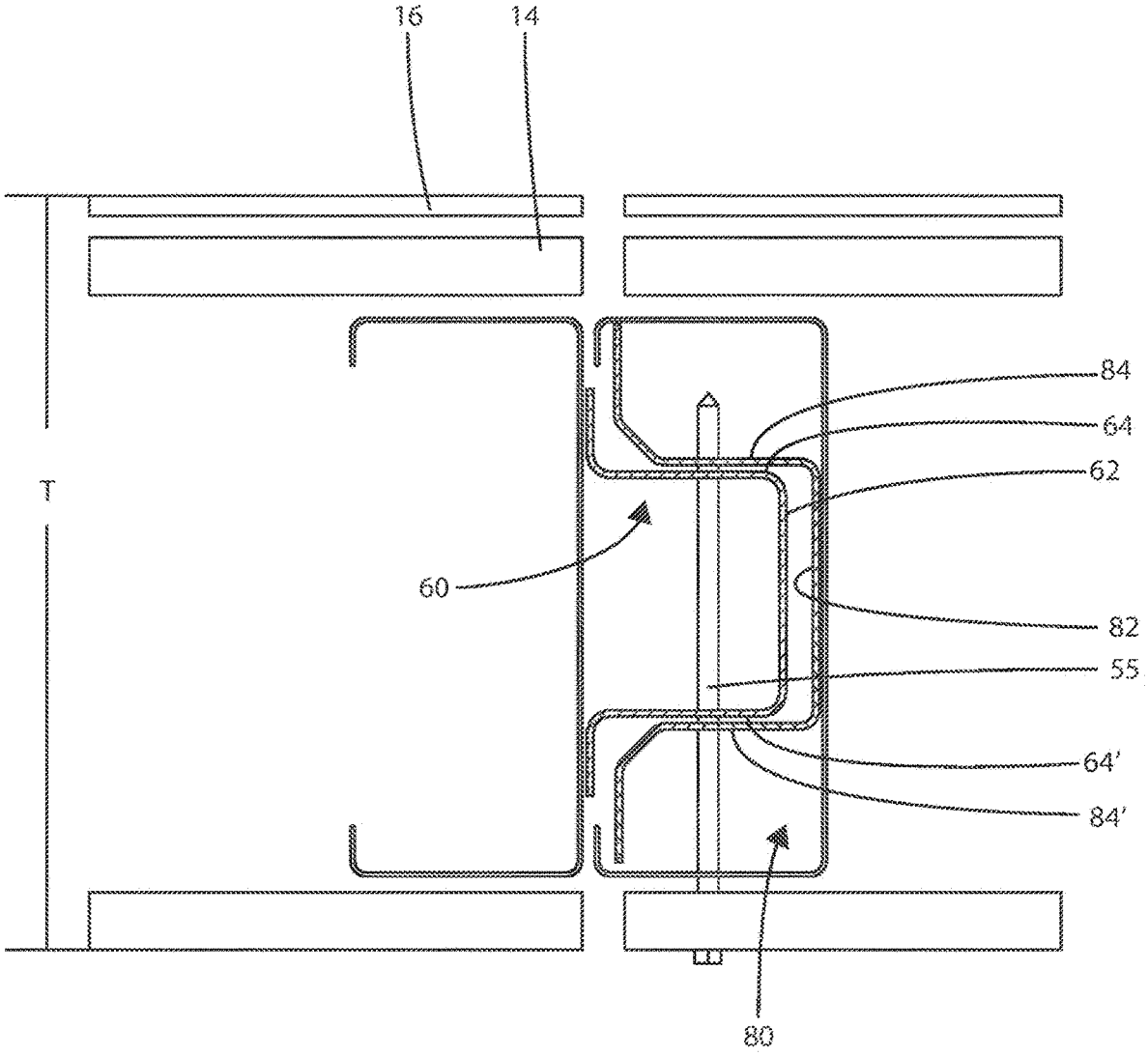
FIG. 5B illustrates a top view of two adjacent prefabricated walls with first and second engaging members engaging each other with a fastening element.
Figure 5C:
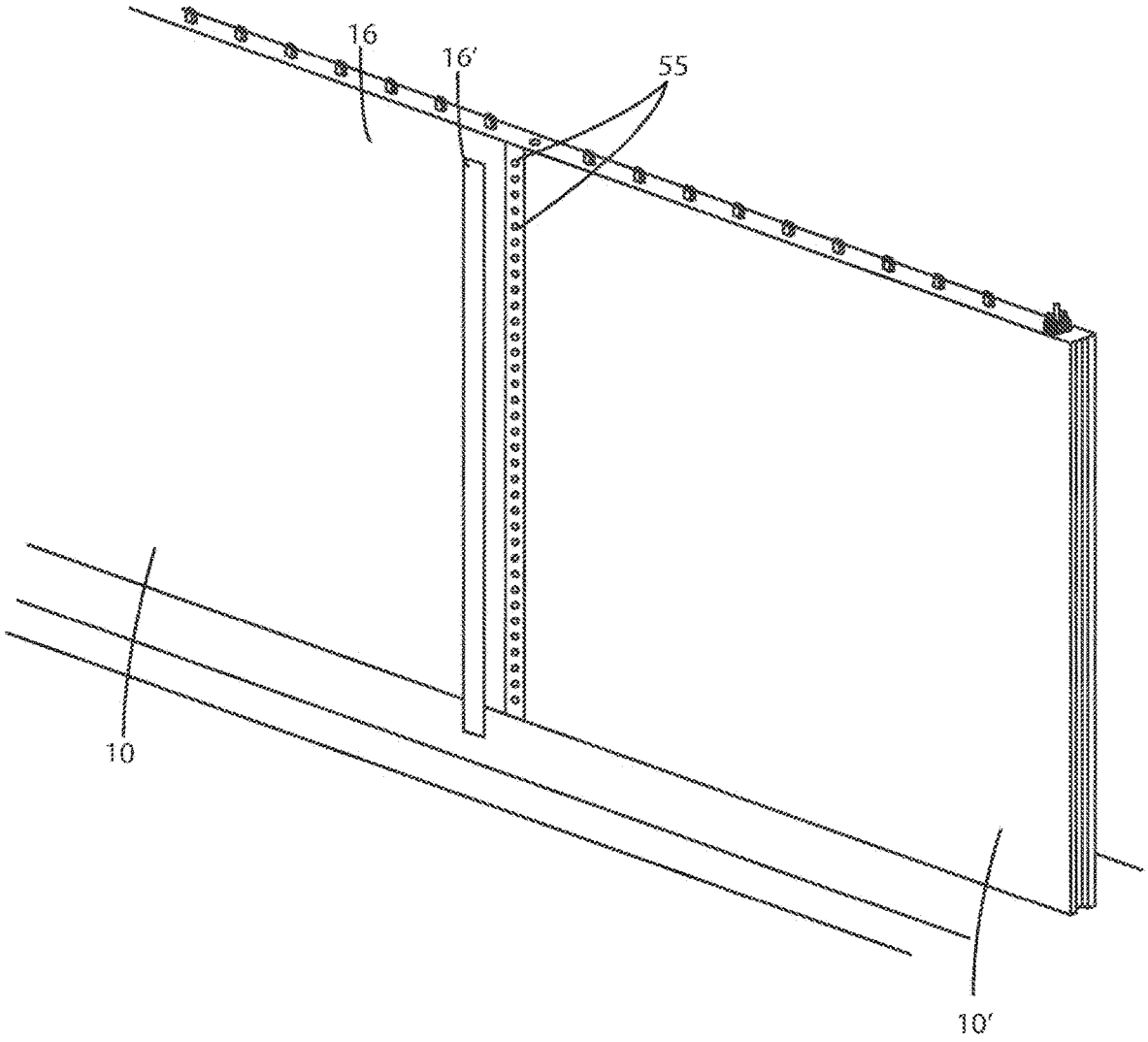
FIG. 5C illustrates a top perspective view of two adjacent prefabricated walls according to an example of the presently disclosed subject matter.
Figure 5D:
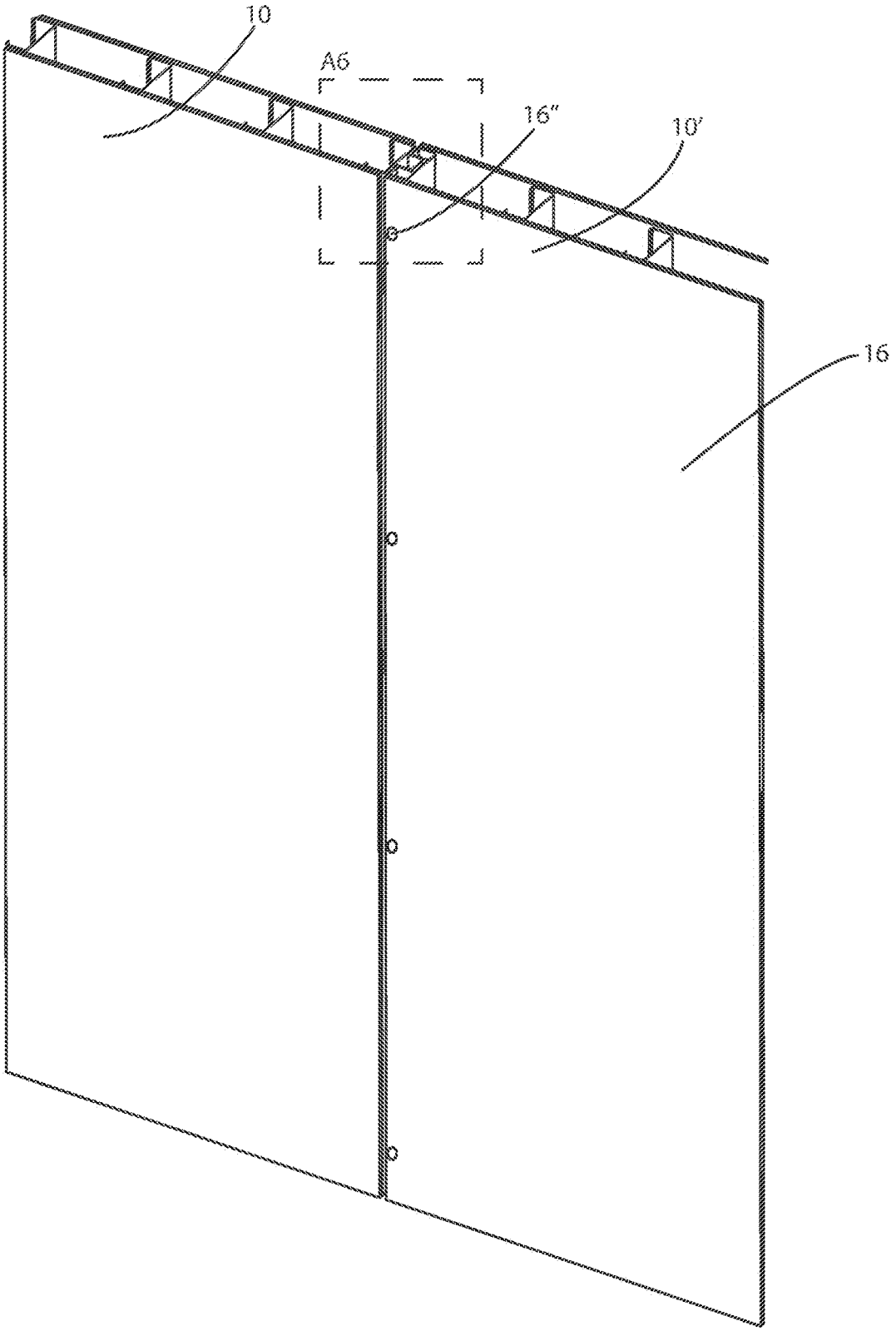
FIG. 5D illustrates a top perspective view of two adjacent prefabricated walls according to another example of the presently disclosed subject matter.
Figure 5E:
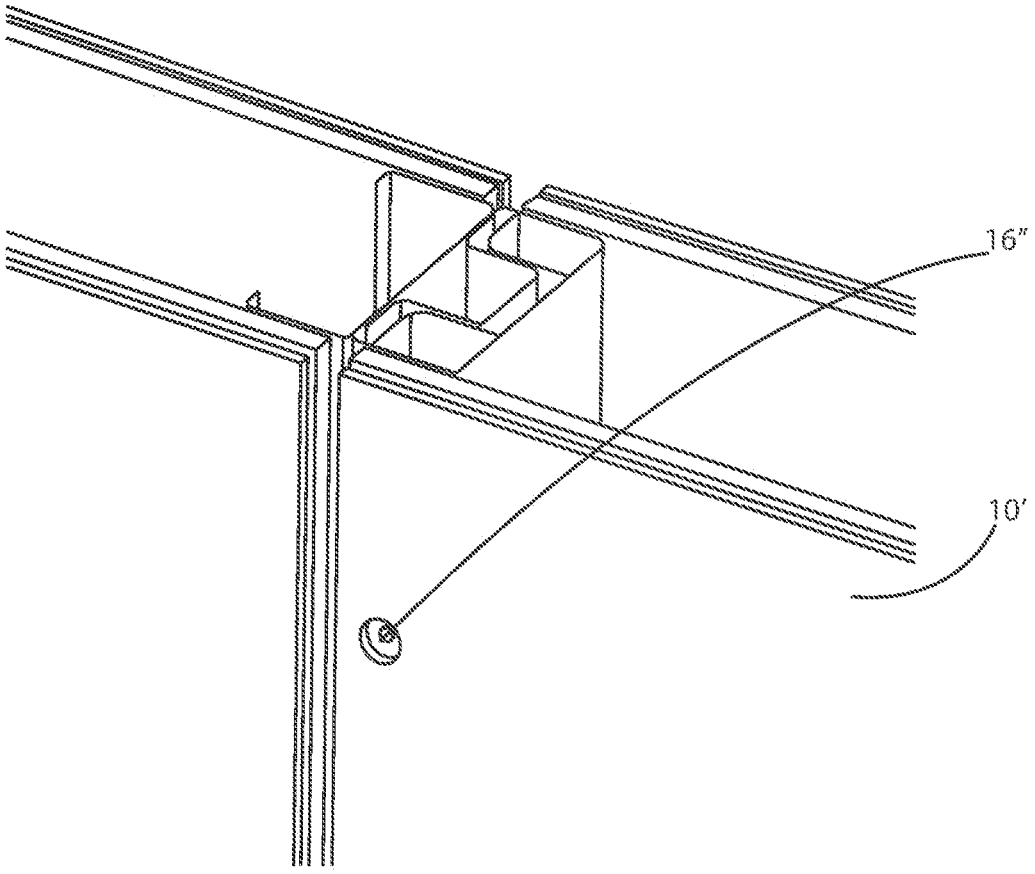
FIG. 5E illustrates an enlarged view of section A6 shown in FIG. 5D.

As shown in FIGS. 5A and 5B, the first engaging member 60 connected to the prefabricated wall 10 is engaged with the second engaging member 80 connected to an adjacent prefabricated wall 10'. In some examples, the first engaging member 60 can be slidingly received within the second engaging member 80 during lowering of the prefabricated wall 10 while the adjacent prefabricated wall 10' has already been installed, such that the protrusion top 62 engages the recess base 82, and the protrusion sides 64 and 64' engage the recess sides 84 and 84'. In some examples, the protrusions base and sides can be spaced from the recess base and sides. As shown in FIG. 5B, a fastening element 55 is inserted through the first engaging member 60 and the second engaging member 80 thereby fastening the first and the second engaging members 60 and 80, and thereby the prefabricated wall 10 and the adjacent wall 10' together. The fastening element 55 is inserted through the recess side walls 84 and 84' and the protrusion side walls 64 and 64' in a direction along the thickness T of the prefabricated wall. The fastening element 55 includes a plurality of fastening elements 55 inserted at multiple locations along the height H of the prefabricated wall 10. As can be seen in FIGS. 5A, 5B, and 5C, the fastening element 55 is inserted through the resistance layer 14, and a strip 16' in the finishing layer 16 is left open during the manufacturing of the wall and can be easily installed on site after inserting the fastening element 55, as can be best seen in FIG. 5C. In another example, as shown in FIG. 5D, the prefabricated wall 10 is delivered to the site completely closed without any opening in the finishing layer 16. The prefabricated wall 10 has markings 16" on the finishing layer 16 indicating the designated locations for the fastening element 55. As can be seen in FIG. 5E, the markings 16" are in the form of depressions such that when the fastening element 55 is inserted, no portion of the fastening element protrudes above the finishing layer 16. In other examples, the markings can be in any other form including symbols, indications, dots, etc.

Figure 6A:
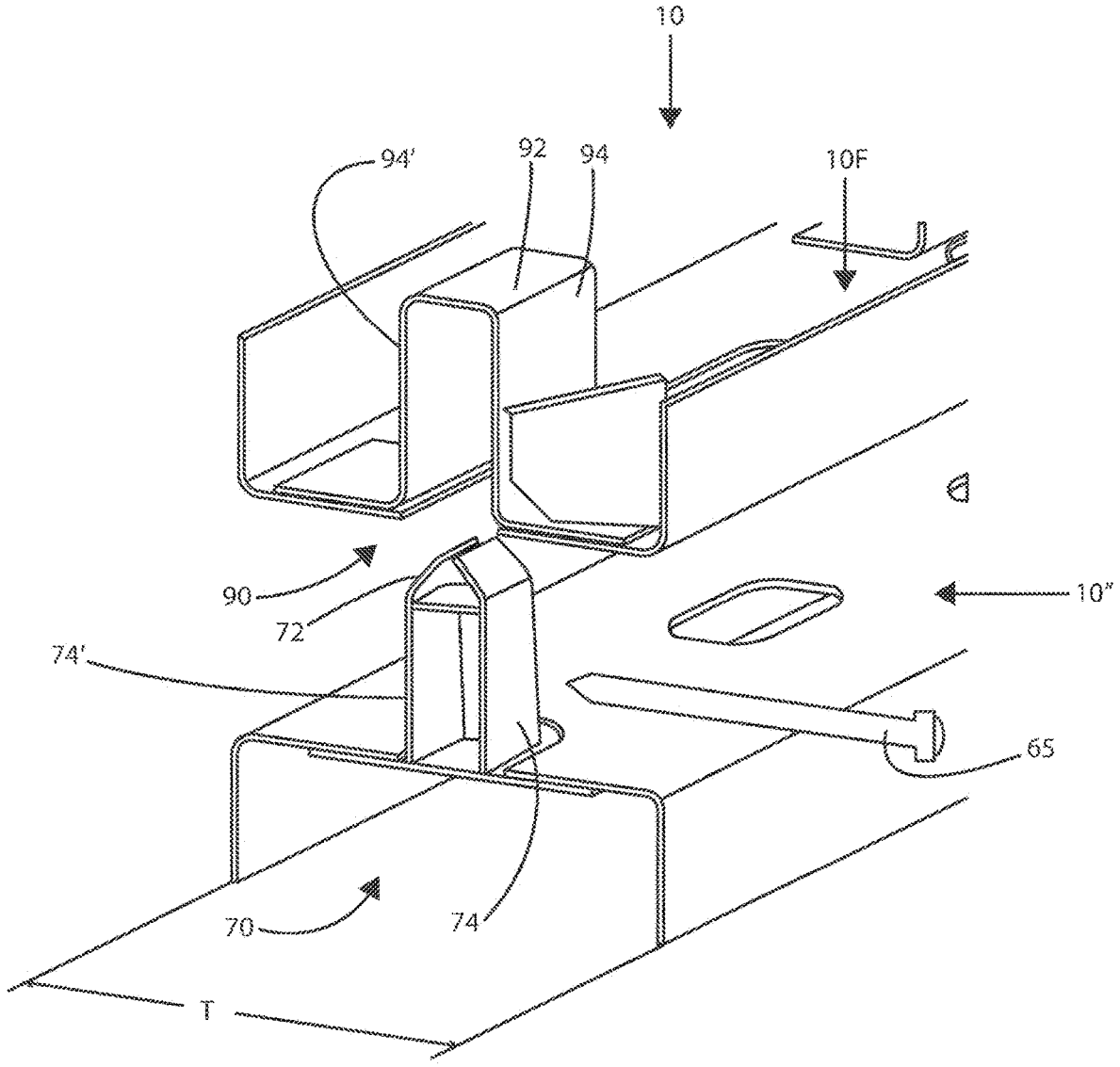
FIG. 6A illustrates a partial perspective view of a top and a bottom prefabricated wall prior to assembly.
Figure 6B:
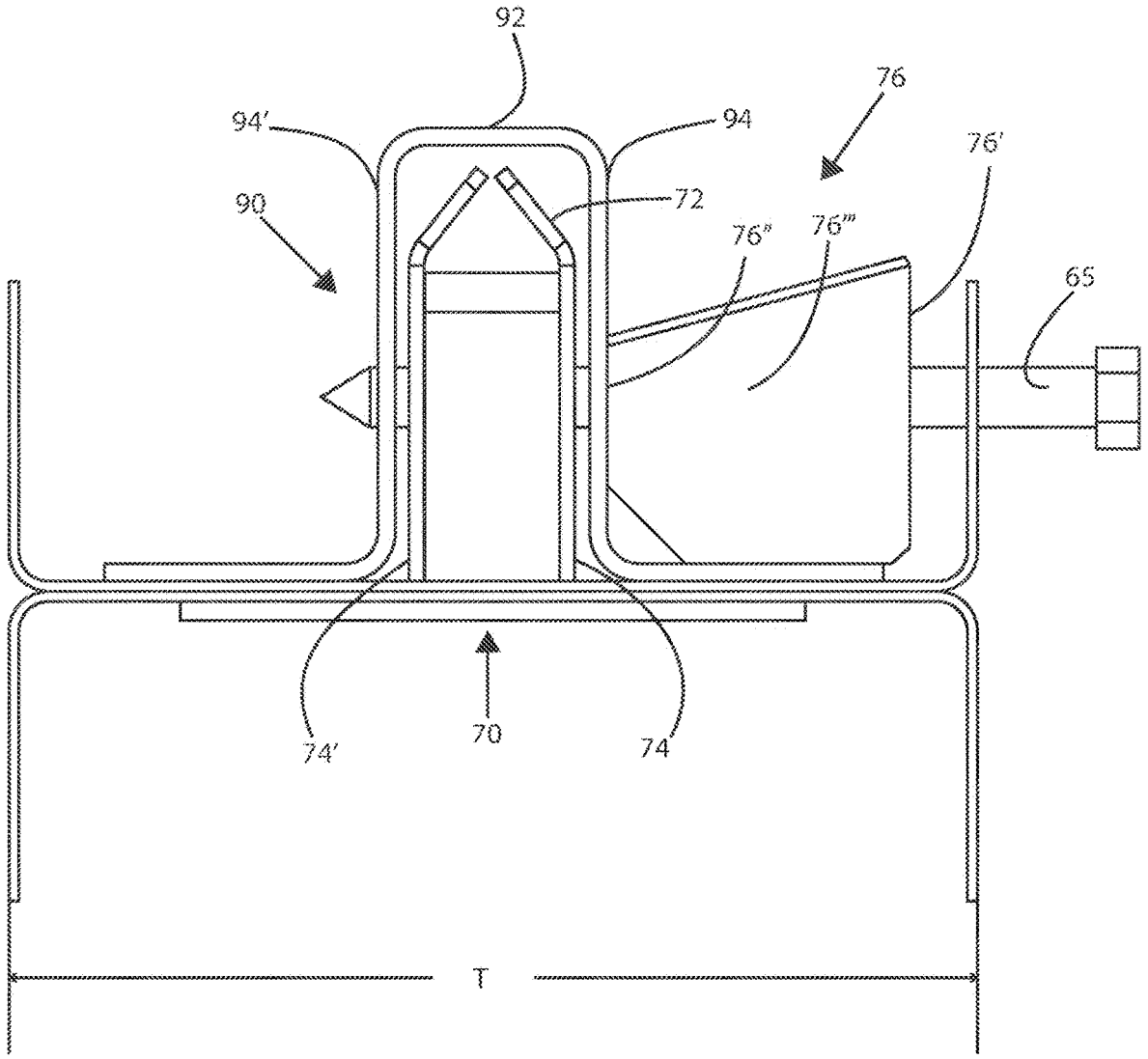
FIG. 6B illustrates a cross-sectional side view of a top and a bottom prefabricated wall after assembly.

FIGS. 6A and 6B illustrate the engagement of the other first engaging member 70 connected to a top prefabricated wall 10" with the other second engaging member 90 connected to the top face 10F of the prefabricated wall 10. In some examples, the other first engaging member 70 can be connected to the prefabricated wall 10, and the other second engaging member 90 can be connected to the top face of a bottom prefabricated wall or the base support element 22. As shown in FIG. 6A, prior to complete lowering of the top wall 10", the other first engaging member 70 aligns above the other second engaging member 90, and other first engaging member 70 receives therewithin the other second engaging member 90 when the top wall 10" is lowered completely onto the prefabricated wall 10, such that the protrusion top 92 engages the recess base 72, and the protrusion sides 94 and 94' engage the recess sides 74 and 74'. In some examples, the protrusions base and sides can be spaced from the recess base and sides. As shown in FIG. 6B, a fastening element 65 is inserted through the other first engaging member 70 and the other second engaging member 90 thereby fastening the first and the second engaging members 70 and 90, and thereby the prefabricated wall 10 and the top wall 10" together. The fastening element 65 is inserted through the recess side walls 74 and 74' and the protrusion side walls 94 and 94' in a direction along the thickness T of the prefabricated wall. The fastening element 65 includes a plurality of fastening elements 65 inserted through each pair of the recesses 70 and protrusions 90. As can be seen in FIG. 6B, the fastener guide 76 guides the fastening element 65 through the recesses 70 and protrusions 90.

It is to be understood herein that the first engaging members and the second engaging members have been described above by the way of a non-limiting example, and one of the first and second engaging members can include protrusions and corresponding other one can include recesses.

The invention claimed is:

1. A system for assembling prefabricated walls, said system comprising:

at least one prefabricated wall having an anchor pathway extending therethrough along a height thereof and between a bottom opening and a top opening;

a first anchoring element;

a second anchoring element configured to be coupled to the first anchoring element, and to be slidingly received and extend along within the anchor pathway;

a coupler configured to couple the second anchoring element to the first anchoring element, said bottom opening being configured for slidably receiving the first anchoring element, the coupler and at least a first end of the second anchoring element coupled to the first anchoring element;

a guiding element configured to be positioned at least partially within the anchor pathway in proximity to the top opening thereof; and an alignment element including a base portion with a through-opening configured to allow the first anchoring element to pass therethrough, and an aligning portion extending from the base portion configured to align the bottom opening of the anchor pathway with the alignment element, wherein the aligning portion comprises at least two main aligning plates perpendicular to the base portion and extending therefrom, and having edges converging in a direction away from the base portion.

2. The system of Claim 1, wherein the aligning portion is configured to be received into the bottom opening of the anchor pathway.

3. The system of Claim 1, wherein a slope of the convergence is gradient slope.

4. The system of Claim 1, wherein a maximum distance between the edges of the main aligning plates corresponds to a respective dimension of the bottom opening.

5. The system of Claim 1, wherein the main aligning plates have respective internal surfaces facing each other and opposite external surfaces, wherein the aligning portion further comprises at least one auxiliary aligning plate extending perpendicularly from the external surface of each of the main aligning plates.

6. The system of claim 5, wherein each of the auxiliary aligning plates has an edge sloped away from the external surface of the main aligning plate in a direction towards the base portion.

7. The system of claim 6, wherein said slope of the edge of the auxiliary aligning plate is gradient slope.

8. The system of claim 6, wherein a maximum distance between the edges of the auxiliary aligning plates of the two main aligning plates corresponds to a respective dimension of the bottom opening.

9. The system according toof claim 1, wherein the guiding element is configured to guide a second end of the second anchoring element into the top opening to pass therethrough from within the anchor pathway.

10. The system of claim 1, wherein the top opening is narrower than at least a majority of the anchor pathway, and the guiding element has a lower end portion having dimensions corresponding to those of the anchor pathway, an upper end portion configured to be positioned adjacent the top opening having dimensions corresponding to those of the top opening, and an intermediate portion extending therebetween.

11. The system of claim 1, wherein the guiding element and the anchor pathway are a single element.

12. The system of claim 1, further comprising a locking element configured to lock the second anchoring element at the top opening.

13. The system of claim 1, wherein the at least one prefabricated wall is configured to be assembled on top of a bottom prefabricated wall identical to the at least one prefabricated wall, wherein the first anchoring element is constituted by an end of another anchoring element protruding from the bottom prefabricated wall.

14. The system of claim 1, wherein a second end of the second anchoring element is configured to constitute the first anchoring element for another top prefabricated wall identical to the at least one prefabricated wall, and configured to be coupled to another anchoring element and be received in anchor pathway of said other top prefabricated wall.

15. The system of claim 14, wherein the alignment element is configured to be positioned at the top opening of the anchor pathway of the at least one prefabricated wall, and is configured to align the other top prefabricated wall onto the at least one prefabricated wall.

16. The system of claim 14, wherein the guiding element is configured to be positioned at least partially within the anchor pathway of the at least one prefabricated wall and is configured to guide the second end of the second anchoring element.

17. The system of claim 16, wherein the alignment element and the guiding element are a single element.

18. The system of claim 1, wherein the first anchoring element protrudes from a base support element.

* * * * *